United States Patent [19]

Cardone

[11] 3,960,558

[45] June 1, 1976

[54] DYE FREE, SPECTRALLY SENSITIVE SILVER HALIDE LAYERS IN DIFFUSION TRANSFER FILMS

[75] Inventor: Paul A. Cardone, Framingham, Mass.

[73] Assignee: Polaroid Corporation, Cambridge, Mass.

[22] Filed: Apr. 29, 1974

[21] Appl. No.: 464,818

[52] U.S. Cl. ..... 96/3; 96/29 D; 96/73; 96/74; 96/77

[51] Int. Cl.[2] ..... G03C 7/00; G03C 1/40; G03C 5/54; G03C 3/00

[58] Field of Search ..... 96/3, 29 D, 77, 68, 96/73, 74

[56] References Cited

UNITED STATES PATENTS

| | | | |
|---|---|---|---|
| 2,376,217 | 5/1945 | Wilder | 96/74 |
| 3,188,209 | 6/1965 | Land et al. | 96/3 |
| 3,415,645 | 10/1968 | Land | 96/3 |
| 3,505,068 | 4/1970 | Beckett et al. | 96/68 |
| 3,591,382 | 7/1971 | Millikan | 96/68 |
| 3,620,745 | 11/1971 | Seymour | 96/68 |
| 3,620,746 | 11/1971 | Barr | 96/68 |
| 3,620,747 | 11/1971 | Marchant | 96/68 |
| 3,663,228 | 5/1972 | Wyckoff | 96/68 |
| 3,728,121 | 4/1973 | Zorn et al. | 96/68 |
| 3,765,886 | 10/1973 | Bush et al. | 96/3 |

*Primary Examiner*—David Klein
*Assistant Examiner*—Richard L. Schilling
*Attorney, Agent, or Firm*—Robert M. Ford; Gerald L. Smith

[57] ABSTRACT

The present invention relates to photography, particularly, to photographic products specifically adapted for employment in specified photographic diffusion transfer color processes and, more particularly, to photographic products which comprise a fixed or permanent composite photosensitive structure including, as essential layers, in sequence, a first dimensionally stable layer transparent to actinic radiation; a polymeric layer dyeable by a diffusion transfer process dye image-forming material; a processing composition permeable opaque layer; a first photosensitive silver halide layer having associated therewith a diffusion transfer process dye image-forming material; a second photosensitive silver halide layer; a second dimensionally stable layer transparent to actinic radiation; and means for providing a diffusion transfer process processing composition preferably retaining opacifying agent intermediate the dye image-forming material impermeable polymeric layer and the next adjacent second transparent dimensionally stable layer; and to specified photographic diffusion transfer color processes employing such products.

34 Claims, 9 Drawing Figures

DYE FREE, SPECTRALLY SENSITIVE SILVER HALIDE LAYERS IN DIFFUSION TRANSFER FILMS

BACKGROUND OF THE INVENTION

1. Field of the Invention

The present invention is directed to providing new and improved diffusion transfer color process photographic film units adapted to provide, as a function of the point-to-point degree of photoexposure, by diffusion transfer processing dye transfer image formation.

2. Description of Prior Art

As disclosed in U.S. Pat. No. 3,672,890 a composite photosensitive structure, particularly adapted for reflection type photographic diffusion transfer color process employment, which comprises a plurality of essential layers including, in sequence, a dimensionally stable layer preferably opaque to incident radiation; one or more silver halide emulsion layers having associated therewith a diffusion transfer process dye image-providing material; a polymeric layer adapted to receive solubilized dye image-providing material diffusing thereto; and a dimensionally stable transparent layer, may be exposed to incident actinic radiation and processed by interposing, intermediate the silver halide emulsion layer and the reception layer, a processing composition and an opacifying agent, which may reflect incident radiation, in a quantity sufficient to mask dye image-providing material associated with the silver halide emulsion.

In a preferred embodiment, the composite photosensitive structure includes a rupturable container, retaining an alkaline processing composition and the opacifying agent, fixedly positioned extending transverse a leading edge of the composite structure in order to effect, upon application of compressive pressure to the container, discharge of the processing composition intermediate the opposed surfaces of the reception layer and the next adjacent silver halide emulsion.

The liquid processing composition, distributed intermediate the reception layer and the silver halide emulsion, permeates the silver halide emulsion layers of the composite photosensitive structure to initiate development of the latent images contained therein resultant from photoexposure. As a consequence of the development of the latent images, dye image-providing material associated with each of the respective silver halide emulsion layers is individually mobilized as a function of the point-to-point degree of the respective silver halide emulsion layer's photoexposure, resulting in imagewise distributions of mobile dye image-providing materials adapted to transfer, by diffusion, to the reception layer to provide the desired transfer dye image. Subsequent to substantial dye image formation in the reception layer, means associated with composite structure are adapted to convert the pH of the film unit from a first processing pH at which dye image-providing material is diffusible as a function of the film unit's photoexposure to a second pH at which the transfer dye image exhibits increased stability, preferably a sufficient portion of the ions of an alkaline processing composition transfers, by diffusion, to a polymeric neutralizing layer to effect reduction in the alkalinity of the composite film unit from a first alkaline processing pH to the second pH at which dye image-providing material is substantially nondiffusible, and further dye image-providing material transfer is thereby substantially obviated.

The transfer dye image is viewed, as a reflection image, through the dimensionally stable transparent layer against the background provided by the opacifying agent, distributed as a component of the processing composition, intermediate the reception layer and next adjacent silver halide emulsion layer. The thus-formed opacifying stratum effectively masks residual dye image-providing material retained in association with the silver halide emulsion layer subsequent to processing.

In U.S. Pat. No. 3,415,644, the dimensionally stable layer of the film unit next adjacent the photosensitive layer or layers is disclosed to be opaque, the opacifying agent is initially disposed in an aqueous alkaline processing composition and the film unit's pH modulating means are disclosed to comprise a polymeric layer disposed intermediate the dimensionally stable transparent layer and the reception layer and adapted to reduce, subsequent to substantial dye transfer image formation, the pH of an aqueous alkaline processing composition from a first processing pH at which the dye image-forming material or materials are soluble and diffusible in the composition as a function of the photoexposure of the photosensitive silver halide layer associated therewith to a second pH at which the dye image-forming material or materials are substantially nondiffusible and, as disclosed in U.S. Pat. No. 3,415,646, the dimensionally stable layer of the film unit next adjacent the photosensitive silver halide layer or layers is disclosed to be transparent to incident actinic radiation and, as further disclosed in U.S. Pat. No. 3,415,645, in such instance the opacifying agent may be initially disposed in the film unit intermediate the reception layer and next adjacent silver halide layer.

As disclosed in U.S. Pat. Nos. 3,615,421 and 3,661,585, the opacifying component of the film unit may optionally be initially disposed as a preformed processing composition permeable layer, intermediate the reception layer and next adjacent silver halide layer, in a concentration which prior to photoexposure is insufficient to prevent transmission therethrough of exposing actinic radiation and which, subsequent to processing, possesses an opacifying capacity effective to mask residual dye image-providing material retained associated with the film unit's silver halide emulsion layers, and in U.S. Pat. No. 3,647,435, the opacifying component of the film unit may optionally be initially formed in situ, intermediate the reception layer and next adjacent silver halide layer, during photographic processing of the film unit.

In U.S. Pat. No. 3,647,437, the opacifying component is disclosed to optionally comprise a light-absorbing reagent such as a dye which is present as an absorbing species at the first pH and which may be converted to a substantially non-absorbing species at the second pH, and in U.S. Pat. Nos. 3,473,925; 3,573,042, and 3,576,626, opacifying and reflecting component, respectively, may be individually interposed intermediate the silver halide layer and reception layer by selective distribution from a composite or a plurality of rupturable containers.

In U.S. Pat. No. 3,573,043, the polymeric neutralizing layer is disclosed to be optionally disposed intermediate the dimensionally stable opaque layer and next adjacent essential layer, i.e., next adjacent silver halide/dye image-providing material component, to effect the designated modulation of film unit's environmental pH; U.S. Pat. No. 3,576,625 discloses the employment of particulate acid distributed within the film unit to effect the modulation of the environmental pH, and U.S. Pat. No. 3,573,044 discloses the employment of processing composition solvent vapor transmissive dimensionally stable layers to effect process modulation of dye transfer as a function of solvent concentration.

Where desired, the film unit may also be constructed in accordance with the disclosure of U.S. Pat. Nos. 3,594,164; 3,594,165; 3,689,262 and 3,701,656 to comprise a composite photosensitive structure including a transparent dimensionally stable layer carrying a reception layer, a processing composition permeable opaque layer and a photo-sensitive silver halide layer and the film unit may include a separate dimensionally stable sheet element adapted to be superposed on the surface of the photosensitive structure opposite the dimensionally stable layer and may further include means such as a rupturable container retaining processing composition for distribution of a processing composition intermediate the sheet and photosensitive structure to effect processing. As further disclosed in certain of the last-cited patents and applications, in structures wherein the receptor is positioned next adjacent the transparent layer or the processing composition and/or the sheet is to be separated from the remainder of the film unit subsequent to processing, the latter elements may optionally include opacifying component.

As disclosed in U.S. Pat. No. 3,620,724, the dimensionally stable layer referred to may be opaque and in which instance the photosensitive silver halide layer is positioned next adjacent the opaque support layer and the opacifying component of the film unit's processing composition permeable opaque layer will be disposed in the unit in a concentration insufficient to prevent transmission therethrough of exposing actinic radiation and which, subsequent to processing, possesses an opacifying capacity effective to mask residual dye image-providing material retained associated with the silver halide layer, and as disclosed in U.S. Pat. No. 3,647,434, the opacifying agent may be optionally formed in such film unit, in situ, during processing of the unit.

In U.S. Pat. No. 3,188,209, it is disclosed that the respective selectively sensitized silver halide and dye image-providing material units of multichromatic diffusion transfer process film units may comprise a construction employing disposition of the dye image-providing material in a silver halide free layer intermediate two separate contiguous silver halide layers of uniform spectral sensitivity and a construction employing disposition of the dye image-providing material in a selectively sensitized silver halide layer in combination with a separate contiguous silver halide layer of the same spectral sensitivity positioned next adjacent the film unit support.

SUMMARY OF THE INVENTION

The present invention is directed to novel photographic diffusion transfer color process film units and specifically to integral diffusion transfer process photographic film units adapted to provide, by diffusion transfer processing, photographic color image reproduction as a function of exposure of such film unit to incident actinic radiation.

In accordance with the present invention, the film units will comprise a plurality of layers including, in relative order, a first dimensionally stable layer transparent to incident actinic radiation; a first photosensitive silver halide layer substantially free of dye image-forming material; a second photosensitive silver halide layer contiguous the first silver halide layer having associated therewith one or more diffusion transfer process dye image-forming materials possessing spectral absorption within the spectral range to which the silver halide layer is sensitive; and opaque layer; a layer adapted to receive dye image-forming material diffusing thereto and a second dimensionally stable layer transparent to incident actinic radiation; means for providing, intermediate the first dimensionally stable layer and next adjacent photosensitive silver halide layer, opacifying agent; and means for providing a processing composition in contact with the photosensitive layers, and, in a particularly preferred embodiment, a processing composition possessing a first pH at which the diffusion transfer process dye image-forming material is diffusible during processing and means for modulating the pH of the film unit from the first pH to a second pH at which dye image-forming material is substantially nondiffusible subsequent to substantial dye transfer image formation.

In accordance with a specifically preferred embodiment of the present invention, a film unit assemblage of the aforementioned general structural parameters will be adapted to be processed, subsequent to photoexposure, in the presence of actinic radiation and the means for interposing the opacifying agent and the processing composition will comprise a rupturable container, retaining the opacifying agent disposed in the processing composition selected, fixedly positioned extending transverse a leading edge of the film unit and adapted, upon application of compressive pressure, to distribute its contents intermediate the first dimensionally stable layer and next adjacent silver halide layer.

BRIEF DESCRIPTION OF THE DRAWINGS

FIGS. 2, 4 and 6 are diagrammatic enlarged cross-sectional views of the film unit of FIG. 1, along section line 2—2, illustrating the association of elements during the three illustrated stages of the performance of a diffusion transfer process, for the production of a multicolor transfer image according to the invention, the thickness of the various materials being exaggerated, and wherein FIG. 2 represents an exposure stage, FIG. 4 represents a processing stage and FIG. 6 represents a product of the prosess.

DETAILED DESCRIPTION OF THE INVENTION

Figure 1:
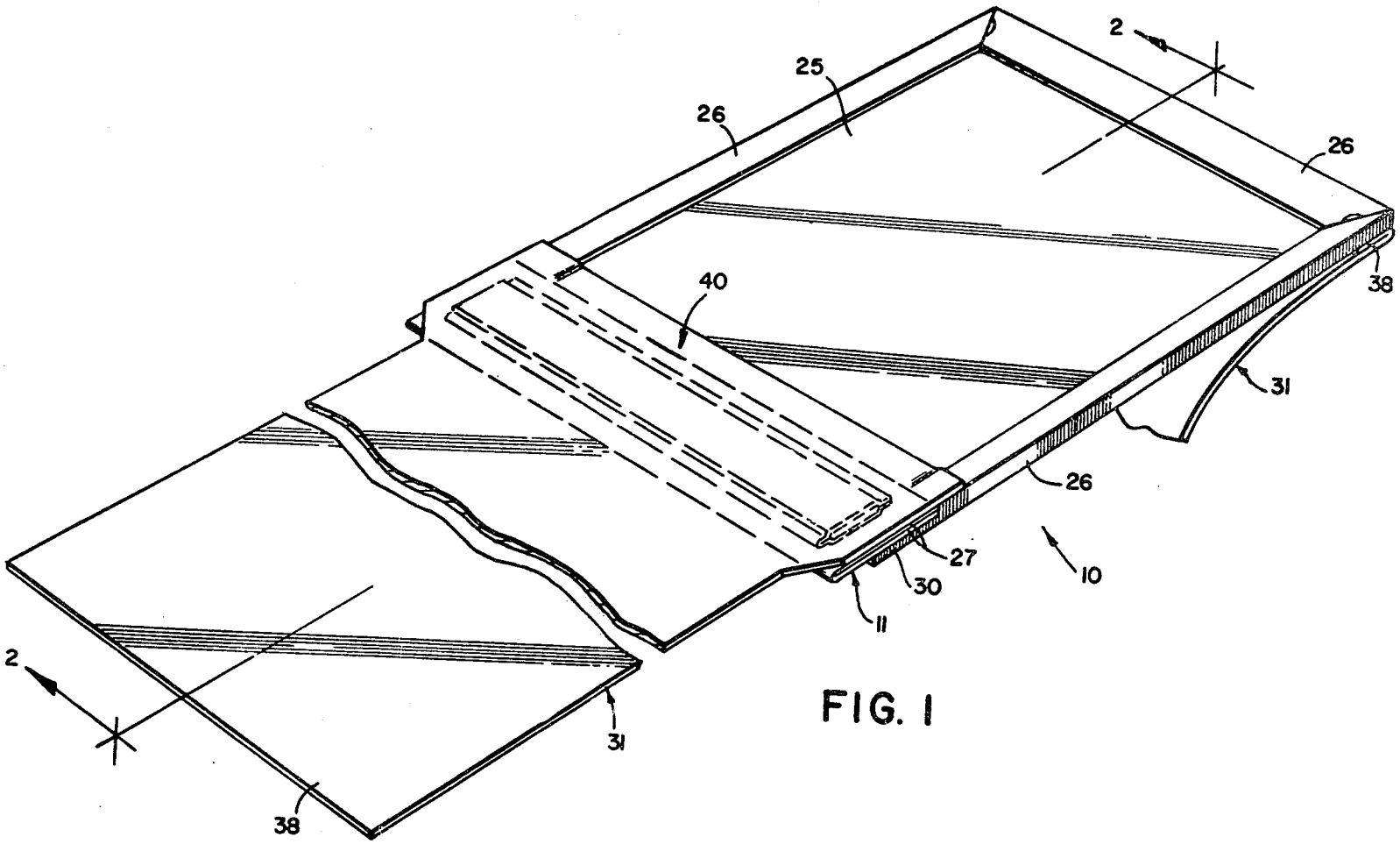
FIG. 1 is a fragmentary perspective view of one embodiment of the photographic film unit accordance with the invention.

As previously characterized, diffusion transfer photographic processing in accordance with the present invention may be employed to provide a position reflection dye image, as a direct function of actinic radiation incident on a film unit assemblage which unit is preferably constructed to comprise a plurality of sequential layers including a first dimensionally stable layer transparent to incident radiation; a first photosensitive silver halide layer substantially free of dye image-forming material; a second photosensitive silver halide layer contiguous the first silver halide layer having associated therewith one or more diffusion transfer process dye image-forming materials possessing spectral absorption within the spectral range to which the silver halide layer is sensitive; an opaque layer; a layer adapted to receive dye image-forming material diffusing thereto; a second dimensionally stable layer transparent to incident radiation; means for interposing intermediate the first dimensionally stable layer and the next adjacent silver halide layer opacifying agent, preferably an inorganic pigment dispersion, in a concentration effective to provide, subsequent to selective photoexposure of the silver halide layer, protection of the silver halide layer from further exposure to actinic radiation incident on the dimensionally stable layer; and means for converting the pH of the film unit from the first processing pH to a second pH at which the transfer image dye is substantially nondiffusible subsequent to substantial dye image formation in the reception layer.

It now has been discovered, however, that improved photographic reproduction in color by diffusion transfer processing may be accomplished by employment of a diffusion transfer process film unit which includes one or more composite photoresponsive units which comprise a first photosensitive layer containing photosensitive silver halide, preferably silver iodobromide, iodochloride or iodochlorobromide grains which possesses a first mean particle size, and a second silver halide layer preferably possessing a second mean particle size, wherein the first mean particle size is less than that of the second mean particle size, and the first silver halide layer possesses a sensitivity to incident actinic radiation in excess of the sensitivity possessed by the second silver halide layer and the second silver halide layer contains a diffusion transfer process dye image-providing material, and a layer adapted to receive dye image-providing material diffusing thereto, as a function of the point-to-point degree of the photo-sensitive layer's exposure to incident actinic radiation.

In a preferred embodiment of the present invention, the silver halide grains, most preferably silver iodobromide, iodochloride and/or iodochlorobromide grains, comprising the first and second layers possess a mean grain size distribution within the range of about 0.2 to 3.0 $\mu$ and, most preferably, within the range of about 0.5 to 2.0 $\mu$.

Employment of diffusion transfer color process film units possessing the defined composite photosensitive silver halide components has been discovered, per square unit coverage of silver halide, to provide increased diffusion transfer process exposure latitude; increased Diffusion Transfer Process Exposure Index; and more efficient and effective utilization of silver, dye image-providing components and photographic adjuvants as, for example, sensitizing dye components of the film unit.

Specifically, the employment of the denoted composite photoresponsive units have been found to enhance the dye diffusion control aspects of the dye transfer process with its concomitant improvement in transfer dye image acuity and resolution, and, in multicolor dye transfer processes, improved dye image separation and segregation, without sacrifice of desired film unit sensitometry characteristics.

In particular it has been discovered, in contradistinction to conventional photosensitive silver halide dye image-forming construction of the art, that if a color diffusion transfer process film unit is constructed as detailed herein whereby in the direction of the film unit's photoexposure there is positioned a composite photosensitive unit in which the initial radiation-receiving photosensitive silver halide layer comprises a relatively small grain, high speed and highly sensitive silver halide dispersion substantially free of dye image-forming material absorbing radiation at wavelengths to which the emulsion is selectively sensitive and in which there is disposed next adjacent to the first photosensitive layer, in coplanar relationship, a second photosensitive layer of relatively large grain constitution which contains dye image-forming material which possesses high covering power by reason of its particle size and surface area, then it is possible to achieve the high speed and sensitivity of a large grain photosensitive silver halide composition in viable combination with an optimized diffusion transfer process dye image control conversant with the employment of a photosensitive formulation directly retaining dye image-forming material and required for optimum dye transfer control, separation and dye image acuity.

In particularly preferred embodiments of the present invention the first and second photosensitive silver halide layer will each comprise a mixed halide of the type discussed above and the photosensitive silver halide will ordinarily be employed at an overall coverage of about 40 to 200 mgs./ft.$_2$, most preferably the first photosensitive layer at a coverage of about 20 to 100 mgs./ft.$^2$ and the second photosensitive layer at a coverage of about 20 to 100 mgs./ft.$^2$, in combination with a selected diffusion transfer process dye image-providing material present in a ration of about 1.5 to 0.4 dye to photosensitive silver halide, e.g., about 30 to 150 mgs./ft.$^2$ dye to photosensitive silver halide disposed at the coverage stated above.

The preferred silver iodochlorobromide, iodochloride and iodobromide type photosensitive layers employed for the fabrication of the photographic film unit, may be prepared by reacting a water-soluble silver salt, such as silver nitrate, with at least one water-soluble halide, such as ammonium, potassium or sodium chloride, together with corresponding ioodide and bromide, or ammonium, potassium or sodium bromide, together with corresponding iodide, in an aqueous solution of a peptizing agent such as colloidal gelatin solution; digesting the dispersion at an elevated temperature, to provide increased crystal growth; washing the resultant dispersion to remove undesirable reaction products and residual water-soluble salts, for example, employing the preferred gelatin matrix material, by chilling the dispersion, noodling the set dispersion, and washing the noodles with cold water, or, alternatively, employing any of the various flocc systems, or procedures, adapted to effect removal of undesired components, for example, the procedures described in U.S. Pat. Nos. 2,614,928; 2,614,929; 2,728,662, and the like; after-ripening the dispersion at an elevated temperature in combination with the addition of gelatin or such other polymeric material as may be desired and various adjuncts, for example, chemical sensitizing agents of U.S. Pat. Nos. 1,574,944; 1,623,499; 2,410,689; 2,597,856; 2,597,915; 2,487,850; 2,518,698; 2,521,926; and the like; all according to the traditional procedures of the art, as described in Neblette, C. B., *Photography Its Materials and Processes*, 6th Ed., 1962.

Optical sensitization of the emulsion's silver halide crystals may be accomplished by contact of the emulsion composition with an effective concentration of the selected optical sensitizing dyes dissolved in an appropriate dispersing solvent such as methanol, ethanol, acetone, water, and the like; all according to the traditional procedures of the art, as described in Hammer, F. M., *The Cyanine Dyes and Related Compounds*.

Additional optional additives, such as coating aids, hardeners, viscosity-modifying agents, stabilitizers, preservatives, and the like, for example, those set forth hereinafter, also may be incorporated in the emulsion formulation, according to the conventional procedures known in the photographic emulsion manufacturing art.

As the binder for the photoresponsive material, the aforementioned gelatin may be, in whole or in part, replaced with some other natural and/or synthetic processing composition permeable polymeric material such as albumin; casein; or zein or resins such as cellulose derivative, as described in U.S. Pat. Nos. 2,322,085 and 2,541,474; vinyl polymers such as described in an extensive multiplicity of readily available U.S. and foreign patents or the photoresponsive material may be present substantially free of interstitial binding agent as described in U.S. Pat. Nos. 2,945,771; 3,145,566; 3,142,567; Newman, *Comment on Non-Gelatin Film*, B. J. O. P., 434, Sept. 15, 1961; and Belgian Patents Nos. 642,557 and 642,558.

Specifically, a preferred silver iodobromide emulsion may be readily formulated by a conventional single jet addition, over a period of 40 minutes, at a rate of 10 liters per minute from the jet, a solution comprising 3 M. silver nitrate, in distilled water, at room temperature, into a solution comprising 3 M. alkali halide (e.g. potassium) possessing 98% bromide and 2% iodide in trimellitic acid anhydride derivatized acid pig gelatin, at room temperature, preadjusted to pH 6 with 5% potassium hydroxide. The resultant silver iodobromide emulsion is held subsequent to formulation for the period of time required to provide the selected silver halide grain size distribution and separation of the silver iodobromide-trimellitic acid anhydride derivatized gelatin precipitate provided by the addition of 2 N. sulfuric acid to the reaction mixture. The resultant precipitate is washed with chilled distilled water until the wash water exhibits a conductivity of about 300 to 500 $\mu$ mhos/cm, the volume adjusted with distilled water for the addition of 100 gms. of lime bone gelatin per 1000 cc. of emulsion, chemically sensitized at about 56° C., pH 5 and pAg 9, by the addition of a sensitizing amount of a solution containing 0.1 gram of ammonium thiocyanate in 9.9 cc. of water and 1.2 cc. of a solution containing 0.097 gram of gold chloride in 9.9 cc. of water, and a 0.02% aqueous sodium thiosulfate solution optimized for the mean silver halide iodide crystal concentration, and the emulsion then afterripening for three hours at a temperature of 60° C. and a pH of 5.5.

In preferred embodiments of the present invention, the composite photosensitive silver halide emulsions employed will be emulsions adapted to provide a Diffusion Transfer Process Exposure Index > about 50, which Index indicates the correct exposure rating of a diffusion transfer color process at which an exposure meter, calibrated to the ASA Exposure Index, must be set in order that it give correct exposure data for producing color transfer prints of satisfactorily high quality. The Diffusion Transfer Process Exposure Index is based on a characteristic H & D curve relating original exposure of the composite photosensitive silver halide emulsions to the respective curve densities forming the resultant transfer image. Thus, the Diffusion Transfer Exposure Index is based on the exposure to which the silver halide emulsions, for use in color diffusion transfer processes, must be subjected in order to obtain an acceptable color transfer image by that process and is a direct guide to the exposure setting to be entered in a camera in order to obtain proper exposure of the film unit.

In accordance with the present invention, it has also been discovered that excellent diffusion transfer dye image characteristic curve shape control, i.e., control of the transfer image characteristics represented graphically by the curve integrating dye density of the transfer image as a function of the log exposure of the photosensitive silver halide layer, may be obtained by utilization of the composite photosensitive silver halide layer structure of the present invention and most expeditiously by utilization of a first photosensitive silver halide layer which comprises a blend of differentially photosensitive silver halide dispersions at least one of the dispersions comprising the silver iodochlorobromide, iodochloride and/or iodobromide dispersions described above in admixture, for example, with a second, etc., silver chlorobromide, -bromide, or, preferably, -iodobromide, -iodochloride or -iodochlorobromide dispersion or dispersions formulated as detailed herein, which blend preferably possesses a mean particle size within the previously denoted range of about 0.2 to 3.0 $\mu$.

Specifically, upon blending the aforementioned differentially sensitive silver halide dispersions, the characteristic curve of the dye transfer image resultant from employment of the blend assumes the "shoulder", i.e., low photosensitive silver halide layer photoexposure region, "speed", i.e., relative measurement defined as a value representing the reciprocal of the exposure required to produce a predetermined result, of the fastest silver halide dispersion and the "toe", i.e., high photosensitive layer photoexposure region, "speed" of the slowest silver halide dispersion, thus increasing the exposure latitude range and lowering the resultant slope of gamma of the curve.

There is thus provided the capacity for controlled formulation of photosensitive layers exhibiting a selectively extended range of predetermined gammas or contrasts and "exposure latitudes" or "dynamic ranges", i.e., the relative measurement of the range of exposure from which a useful dye transfer image may be derived; the instant invention thereby providing the capability of a high maximum density, low minimum density and extended dynamic dye diffusion transfer imaging system and thus adapted to more advantageously reproduce, as dye transfer image differences, the luminance differences existing in an object to be photographically reproduced, including optimization of the minimum useful exposures required to reproduce minimum differences existing in the shadow of the object to be reproduced by means of some minimum density differences in resultant dye transfer image conformation.

In view of the fact that the preferred dye image-forming materials comprise dyes which are silver halide developing agents, as stated above, for purposes of simplicity and clarity, the present invention will be further described hereinafter in terms of such dyes, without limitation of the invention to the illustrative dyes denoted, and, in addition the photographic film unit structure will be detailed hereinafter employing the last-mentioned preferred structural embodiment, without limitation of the invention to the preferred structure denoted.

The dye developers are compounds which contain, in the same molecule, both the chromophoric system of a dye and also a silver halide developing function. By "a silver halide developing function" is meant a grouping adapted to develop exposed silver halide. A preferred silver halide developing function is a hydroquinonyl group. Other suitable developing functions include ortho-dihydroxyphenyl and ortho- and para-amino substituted hydroxyphenyl groups. In general, the developing function includes a benzenoid developing function, that is, an aromatic developing group which forms quinonoid or quinone substances when oxidized.

The dye developers are preferably selected for their ability to provide colors that are useful in carrying out subtractive color photography, that is, the previously mentioned cyan, magenta and yellow. The dye developers employed may be incorporated in the respective silver halide emulsion, in a preferred embodiment, or in a separate layer contiguous the respective silver halide stratum. Specifically, the dye developer may, for example, be in a coating or layer behind or directly disposed in the respective silver halide stratum and such dye developer structure may by applied by use of a coating solution containing about 0.5 to 8 percent, by weight, of the respective dye developer distributed in a film-forming natural, or synthetic, polymer, for example, gelatin, polyvinyl alcohol, and the like, adapted to be permeated by the chosen diffusion transfer fluid composition.

An extensive compilation of specific dye developers particularly adapted for employment in photographic diffusion transfer processes is set forth in U.S. Pat. No. 2,983,606 and in the various copending U.S. applications referred to in that patent, especially in the table of U.S. applications incorporated by reference into the patent as detailed in column 27. As examples of additional U.S. patents detailing specific dye developers for photographic transfer process use, mention may be made of U.S. Pat. Nos. 2,983,605; 2,992,106; 3,047,386; 3,076,808; 3,076,820; 3,077,402; 3,126,280; 3,131,061; 3,134,762; 3,134,765; 3,135,604; 3,135,605; 3,135,606; 3,135,734; 3,141,722; 3,142,565; and the like.

The silver halide composite units comprising the multicolor photosensitive laminate preferably possess predominant spectral sensitivity to separate regions of the spectrum and each has associated therewith a dye developer which is, most preferably, substantially soluble in the reduced form only at a first pH possessing, subsequent to processing, a spectral absorption range substantially complementary to the predominant sensitivity range of its associated emulsion.

In a preferred embodiment of the present invention, the film unit is specifically adapted to provide for the production of a multicolor dye transfer image and the photosensitive laminate comprises, in order, at least two selectively sensitized silver halide emulsions each having dye image-providing material of predetermined image color subsequent to processing associated therewith which is soluble and diffusible substantially only at a first pH, as a function of the photoexposure of its associated silver halide emulsion stratum and at least one of the units comprises a composite structure in accordance with the present invention.

The silver halide emulsion units comprising the multicolor photosensitive laminate preferably possess predominant spectral sensitivity to separate regions of the spectrum and each has associated therewith a dye, which is a silver halide developing agent and is, most preferably, substantially soluble in the reduced form only at a first pH, possessing subsequent to photoexposure or possessing a spectral absorption range substantially complementary to the predominant sensitivity range of its associated emulsion. Where desired silver halide units may employ dyes which exhibit major spectral absorption outside of the primary regions of the spectrum to which the associated silver halide emulsion is sensitive and a spectral transmission substantially complementary to that absorption, during exposure of the emulsion, and major spectral absorption within the spectral range to which the associated silver halide emulsion is sensitive and a spectral transmission substantially complementary to that absorption, subsequent to exposure or processing of said emulsion, for example, of the type disclosed in U.S. Pat. No. 3,307,947.

In one embodiment each of the emulsion units, and its associated dye, may be spaced from the remaining emulsion strata, and their associated dye, by separate alkaline solution permeable polymeric interlayers and the deyeable polymeric layer next adjacent the polymeric acid layer may be separated from that layer by an alkaline solution permeable polymeric spacer layer, most preferably a polymeric spacer layer having decreasing permeability to alkaline solution with increasing temperature.

In such preferred embodiments of the invention, the silver halide emulsion comprises photosensitive silver halide dispersed in gelatin and is about 0.6 to 6 microns in thickness; the dye itself may be dispersed in an aqueous alkaline solution permeable polymeric binder, preferably gelatin, as a separate layer about 1 to 7 microns in thickness; the alkaline solution permeable polymeric interlayers, for example, gelatin may be about 1 to 5 microns in thickness; the alkaline solution permeable and dyeable polymeric layers are transparent and may be about 0.25 to 0.4 mil in thickness; the alkaline solution polymeric spacer layers are transparent and may be about 0.1 to 0.7 mil in thickness; the alkaline solution permeable polymeric acid layers are transparent and may be about 0.3 to 1.5 mils in thickness; and the dimensionally stable transparent layers are alkaline solution impermeable and may be about 2 to 6 mils in thickness. It will be specifically recognized that the relative dimensions recited above may be appropriately modified, in accordance with the desires of the operator, with respect to the specific product to be ultimately prepared.

In the preferred embodiment of the present invention's film unit for the production of a multicolor transfer image, the respective silver halide/dye developer units of the photosensitive element will be in the form of a tripack configuration which will ordinarily comprise a yellow dye developer/blue-sensitive emulsion unit, a cyan dye developer/ red-sensitive emulsion unit and a magenta dye developer/green-sensitive emulsion unit intermediate those units, recognizing that the relative order of such units may be varied in accordance with the desires of the operator.

In those instances, where either or both the respective yellow and magenta dye developers, employed in a preferred tripack configuration which positions the yellow dye developer/blue-sensitive emulsion unit distal the opaque layer dimensionally stable transparent layer and the cyan dye developer/red-sensitive emulsion unit proximal the opaque layer to provide the multicolor transfer image, comprise a dye developer which exhibits major spectral absorption outside of the primary region of the spectrum to which its associated silver halide emulsion is sensitive and a spectral transmission substantially complementary to that absorption, during exposure of the emulsion, then, in many circumstances, it may be advantageous to incorporate filter agents adapted to insure the correct selective exposure of the respective emulsions less proximal the exposure surface of the laminate. Specifically, in the instance where the yellow dye developer exhibits major spectral transmission within the primary regions of the spectrum to which its associated silver halide emulsion is sensitive, that is, the blue region of the visible spectrum, during exposure of the emulsions, then a yellow filter agent may advantageously be incorporated intermediate the blue-sensitive emulsion and the remaining green- and red-sensitive emulsions, in order to prevent undesired exposure of the latter emulsions by reason of their inherent sensitivity to actinic radiation within the blue range of the spectrum generally present. In the instance where the magenta dye developer employed exhibits major spectral transmission within the primary region of the spectrum to which its associated silver halide emulsion is sensitive, that is, the green region of the visible spectrum, during exposure of the emulsions, a magenta filter agent may be advantageously incorporated intermediate the green- and red-sensitive emulsions in instances wherein the red-sensitive emulsion possesses sensitivity to actinic radiation within the green region of the spectrum.

Reference is now made to FIGS. 1 through 7 of the drawings wherein there is illustrated a preferred film unit of the present invention and wherein like numbers, appearing in the various figures, refer to like components.

As illustrated in the drawings, FIG. 1 sets forth a perspective view of the film unit, designated 10, and each of FIGS. 2 through 7 illustrate diagrammatic cross-sectional views of film unit 10, along the stated section lines 2—2, 3—3, 5—5 and 7—7, during the various depicted stages in the performance of a photographic diffusion transfer process as detailed hereinafter.

Film unit 10 comprises rupturable container 11, retaining, prior to processing, aqueous alkaline solution 12, and photosensitive element 13 including, in order, dimensionally stable transparent layer 24*a;* neutralizing layer 23*a;* spacer layer 23*a;* processing composition permeable, auxiliary layer 25; blue-sensitive silver halide emulsion layer 15*a;* blue-sensitive silver halide emulsion layer 15*b* containing yellow dye developer; interlayer 16; green-sensitive silver halide emulsion layer 17*a; green-sensitive silver halide emulsion layer 17b* containing magenta dye developer; interlayer 18; red-sensitive silver halide emulsion layer 19*a;* red-sensitive silver halide emulsion layer 19*b* containing cyan dye developer; opaque layer 20; image-receiving layer 21; spacer layer 22*b;* neutralizing layer 23*b;* and dimensionally stable transparent layer 24*b*, both layers 24*a* and 24*b* comprising an actinic radiation transparent and processing composition impermeable flexible sheet material.

Photosensitive s 13 may be provided with a binding member 26 extending around, for example, the specified edges of the element maintaining the element intact except at the interface between spacer layer 22*a* and auxiliary layer 25 during distribution of processing composition 12. As illustrated in the figures, the binding member may comprise a pressure-sensitive tape 26 securing the photosensitive element components together at film unit 10's specified edges. Tape 26 will also act to maintain processing composition 12 intermediate first spacer layer 22*a*/auxiliary layer 25 and upon application of compressure pressure to container 11 and distribution of its contents intermediate stated components 22*a* and 25. Under such circumstances, binder tape 26 will act to prevent leakage of processing composition from the film unit during and subsequent to photographic processing.

As illustrated, binding sheet 26 overlying and secured to the trailing edge sections of transparent layer 24*a* and transparent layer 24*b* cooperates with the trailing edge of each of the transparent layers to provide an enclosed chamber or trap area 2 adapted to secure and retain excess processing composition 12, employed to insure adequate processing composition coverage upon distribution. To further facilitate distribution of processing composition 12 between transparent layer 24*a* and transparent layer 24b, binding member 26 may be provided with one or more air release vents 1 associated with the trailing edge section of the film unit and preferably in direct communication with trap chamber 2 in order to facilitate release of air from the film unit during distribution of processing composition 12.

Rupturable container 11 may be of the type shown and described in any of U.S. Pat. Nos. 2,543,181; 2,634,886; 2,653,732; 2,723,051; 3,056,491; 3,056,492; 3,152,515; and the like. In general, such containers will comprise a rectangular blank of fluid- and air-impervious sheet material folded longitudinally upon itself to form two walls 27 which are sealed to one another along their longitudinal and end margins to form a cavity in which processing solution 12 is retained. The longitudinal marginal seal 28 is made weaker than the end seals 29 so as to become unsealed in response to the hydraulic pressure generated within the fluid contents 12 of the container by the application of compressive pressure to walls 27 of the container.

Figure 2:
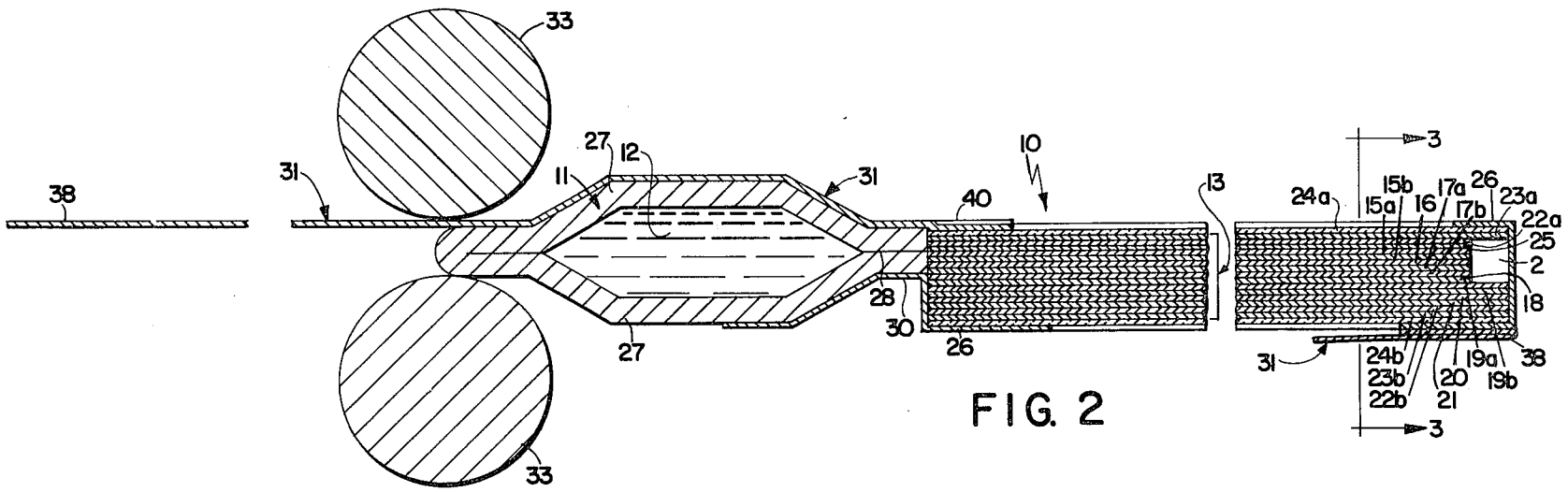
Figure 3:
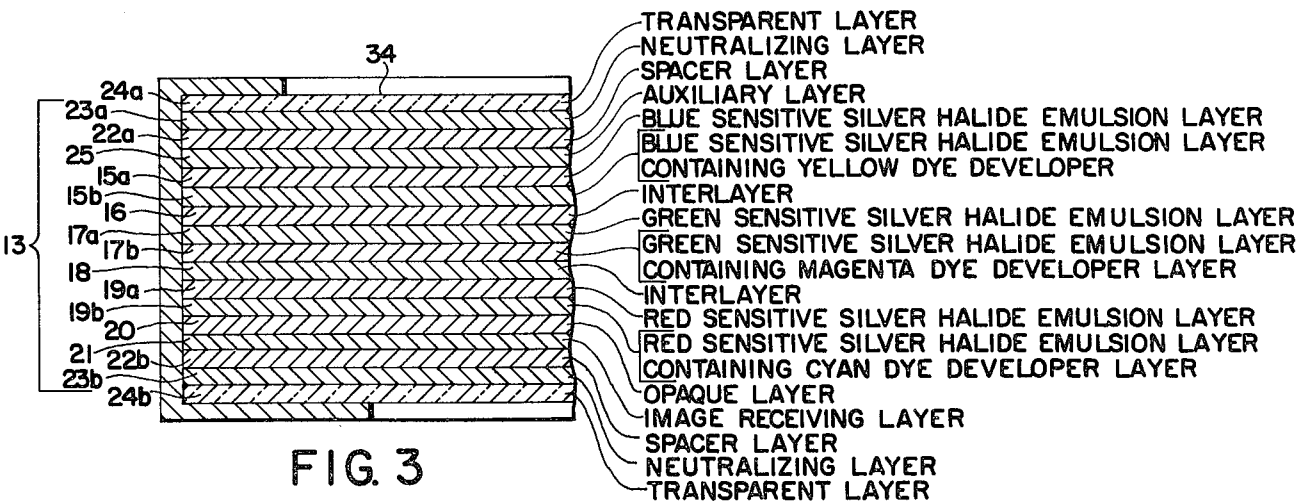
FIGS. 3, 5 and 7 are diagrammatic, further enlarged cross-sectional views of the film unit of FIGS. 2, 4 and 6, along section lines 3—3, 5—5 and 7—7, respectively, further illustrating, in detail, the arrangement of layers comprising the photosensitive laminate during the three illustrated stages of the transfer process.
Figure 4:
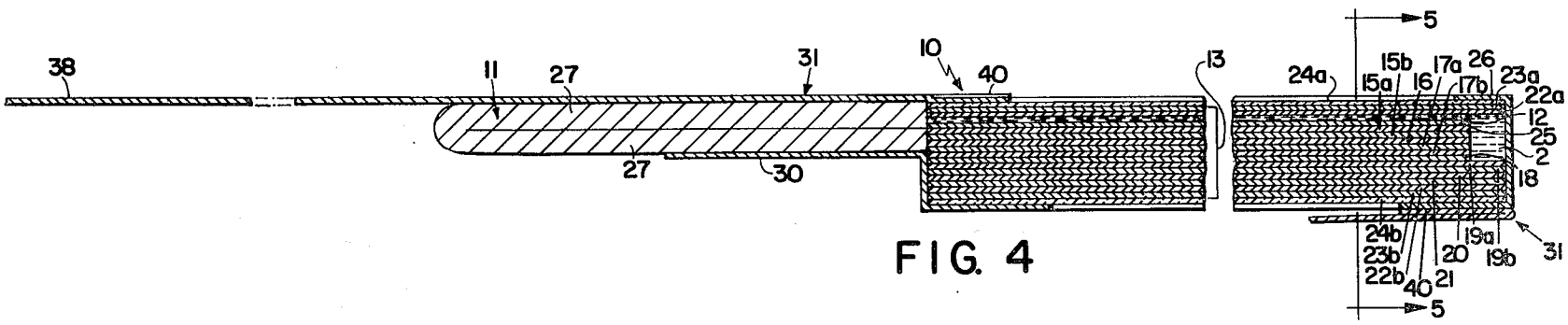
Figure 5:
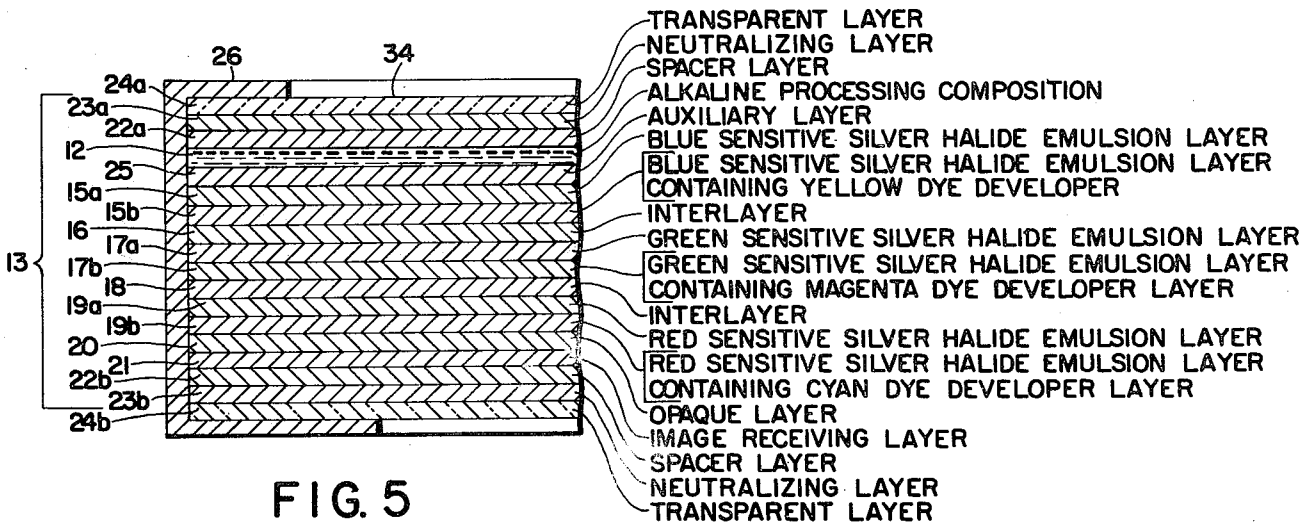
Figure 6:
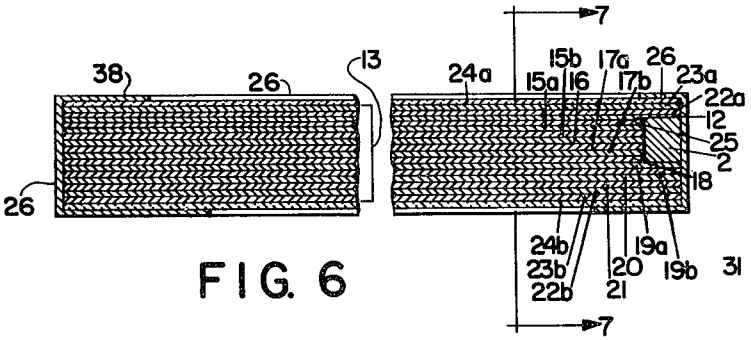
Figure 7:
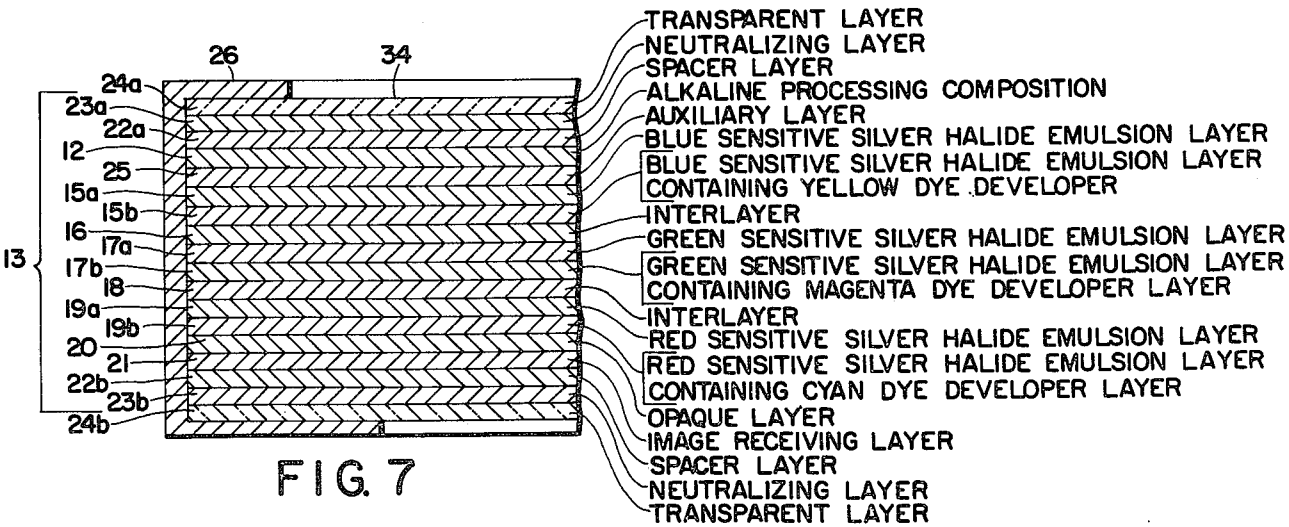

As illustrated in FIGS. 1, 2 and 4, container 11 is fixedly positioned and extends transverse a leading edge of photosensitive laminate 13 whereby to effect unidirectional discharge of the container's contents 12 intermediate first spacer layer 22*a* and barrier layer 25, upon application of compressive force to container 11. Thus, container 11, as illustrated in FIG. 2, is fixedly positioned and extends transverse a leading edge of laminate 13 with its longitudinal marginal seal 28 directed toward the leading edge of the stated interface. As shown in FIGS. 1, 2 and 4, container 11 is fixedly secured to laminate 13 by extension 30 of tape 26 extending over a portion of one wall 27 of the container, in combination with a separate retaining member such as illustrated retaining tape 31 extending over a portion of the other wall 27 of the container and a portion of laminate 13's surface generally equal in area to about that covered by tape 26.

As illustrated in FIGS. 1, 2 and 4, extension flap 30 of tape 26 may be of such area and dimensions that upon, for example, manual separation of container 11 and leader 31, subsequent to distribution of the composition, from the remainder of film unit 10, flap 30 may be folded over the edge of laminate 13, previously covered by leader 31, in order to facilitate maintenance of the laminate's structural integrity, for example, during the flexations inevitable in storage and use of the processed film unit, and to provide a suitable mask or frame, for viewing of the transfer image through the picture viewing area of transparent layer 24. Preferably, however, the film unit will be maintained intact subsequent to processing including retention of the exhausted container, the processing composition in the spacial position assumed during processing. In such instance, the processing composition employed should possess the requisite adhesive capacity, in both the fluid and dry states, to enhance the integrity and stability of the spacial arrangement assumed.

In general, in a particularly preferred embodiment, the opacity of processing composition 12 when distributed will be sufficient to prevent further exposure of the film unit's silver halide emulsion or emulsions, by actinic radiation incident on transparent layer 24*a* during processing of the unit in the presence of radiation actinic to the emulsion or emulsions. Accordingly, the film unit may be processed, subsequent to exposure, in the presence of such radiation, in view of the fact that the silver halide emulsion or emulsions of the laminate are appropriately protected from incident radiation, at one major surface by the opaque layer or layers 20 and at the remaining major surface by opaque processing composition 12 as further described hereinafter. If the illustrated binder tapes are also opaque, as stated above, edge leakage of actinic radiation incident on the emulsion or emulsions will also be prevented. The selected opaque layer or layers 20, however, should be one providing a background suitable for viewing the respective dye developer transfer image formed in the dyeable polymeric layer. In general, while substantially any opaque processing composition and permeable opaque layer may be employed, it is preferred that a processing composition and layer be selected that will not interfere with the color integrity of the dye transfer image carried by the reception layers, as viewed by the observer, and, most preferably, an opaque processing composition and opaque layer which is aesthetically pleasing to the viewer and does not provide a background noise signal degrading, or detracting from, the information content of the dye image. Particularly desirable opaque compositions will be those providing a white background, for viewing the transfer image, and specifically those adapted to be employed to provide background for reflection photographic prints and, especially, those layers possessing the optical properties desired for reflectance of incident radiation.

The opaque layer may comprise substantially any opacifying agent compatible with the photographic system, such as, for example, barium sulfate, titanium dioxide, barium stearate, silver flake, zirconium oxide, and the like, which may be distributed in a permeable polymeric matrix or binder, such as, for example, gelatin, polyvinyl alcohol, and the like.

A particularly preferred opaque layer comprises titanium dioxide due to its highly effective reflection properties. In general, a coating composition, for example, hydroxyethylcellulose, containing sufficient titanium dioxide to provide a precent reflectance of about 85 to 90 percent, respectively, will be employed. In the most preferred embodiments, the percent reflectance desired thus will be in the order of > about 85 percent.

Where it is desired to increase the opacifying capacity of a layer containing, for example, titanium dioxide, beyond that ordinarily obtained, an additional opacifying agent such as carbon black, for example, in a concentration of about one part carbon black to one hundred to five hundred parts titanium dioxide may be provided to the layer. Preferably, however, such additional opacifying capacity will be provided by constituting the opacifying layer as a plurality of more or less discrete layers, the layer next adjacent the transparent support comprising a reflection layer and the succeeding layer or layers comprising one or more opacifying agents possessing greater opacifying capacity than that ordinarily obtained from the reflecting agent or agents employed.

Such additional opacifying agent may be any of the multiplicity of such agents known in the art such as carbon black, iron oxide, titanium (III) oxide, titanium (III) hydroxide, and the like. In preferance, the agent or agents should be selected which possess the maximum opacifying capacity per unit weight, is photographically nondeleterious and is substantially nondiffusible throughout the film unit subsequent to distribution. A particularly preferred agent has been found to comprise carbon black employed in a concentration effective, taken together with the selected reflecting agent, to provide the opacity required to prevent undesired physical fogging of the emulsion formulations selected and employed by radiation transmitted through the spread processing composition.

The fluid contents of the container preferably comprise an aqueous alkaline solution having a pH and solvent concentration at which the dye developers are soluble and diffusible and contains inorganic pigment in a quantity sufficient, upon distribution, to provide a layer exhibiting optical transmission density > about six to prevent exposure of photosensitive silver halide emulsion layers 15*a*, 15*b*, 17*a*, 17*b*, 19*a* and 19*b* by actinic radiation incident on dimensionally stable transparent layer 24a during processing in the presence of such radiation and to afford immediate viewing of dye image formation in image-receiving layer 21 during and subsequent to dye transfer image formation. Accordingly, the film unit may be processed, subsequent to distribution of the composition, in the presence of such radiation, in view of the fact that the silver halide emulsion or emulsions of film unit 10 are appropriately protected by incident radiation, at one major surface of the opaque processing composition and at the remaining major surface by opaque layer 20. If the illustrated binder tapes are also opaque, edge leakage of actinic radiation incident on the emulsion or emulsions will also be prevented.

As examples of pigments adapted for employment in processing composition 12, mention may be made of those specifically identified above.

A particularly preferred processing composition reflecting agent comprises carbon black due to its highly effective light-absorption properties.

In general, the opacifying adjuvants to be employed are those which remain substantially immobile within their respective compositions during and subsequent to photographic processing and particularly those reflecting agents which comprise insoluble and nondiffusible inorganic pigment dispersions within the composition in which they are disposed.

Where desired, opacifying adjuvants constituting layer 20 accordingly may thus be distributed within a processing composition permeable polymeric matrix such as gelatin and/or any other such polymeric matrixes as are specifically denoted throughout the specification as suitable for employment as a matrix binder and may be distributed in one or more of the film unit layers which may be separated or contiguous, intermediate the imagereceiving layer and next adjacent silver halide layer, provided that its distribution and concentration is effective to provide the denoted post processing masking function, and the opacifying agent component of the processing composition may be ultimately disposed within the processing composition residuum located intermediate auxiliary layer 25 and transparent layer 24*a*.

In the performance of a diffusion transfer multicolor process employing film unit 10, the unit is exposed to radiation, actinic to photosensitive laminate 13, incident of the laminate's exposure surface 34, as illustrated by FIG. 2.

Subsequent to exposure as illustrated by FIGS. 2 and 4, film unit 10 is processed by being passed through opposed suitable gapped rolls 33 in order to apply compressive pressure to frangible container 11 and to effect rupture of longitudinal seal 28 and distribution of processing composition 12, containing opacifying agent and having a pH at which the cyan, magenta and yellow dye developers are soluble and diffusible, intermediate first spacer layer 22a and auxiliary layer 25 coextensive their respective surfaces.

Processing composition 12 permeates through auxiliary layer 25 and into emulsion layers 15*a*, 15*b*, 17*a*, 17*b*, 19*a* and 19*b* to initiate development of the latent images contained in the respective emulsions. The cyan, magenta and yellow dye developers, of layers 15*b*, 17*b* and 19*b*, are immobilized, as a function of the development of their respective associated silver halide emulsions, preferably substantially as a result of their conversion from the reduced form to their relatively insoluble and nondiffusible oxidized form, thereby providing imagewise distributions of mobile, soluble and diffusible cyan, magenta and yellow dye developer, as a function of the point-to-point degree of their associated emulsions' exposure. At least part of the imagewise distributions of mobile cyan, magenta and yellow dye developer transfer, by diffusion, to processing composition dyeable polymeric layer 21 to provide to such layer a multicolor dye transfer image viewable through dimensionally stable transparent layer 24b. Subsequent to substantial transfer image formation, a sufficient portion of the ions comprising aqueous composition 12 transfer, by diffusion, through permeable spacer layers 22*a* and 22*b* and to permeable polymeric acid layers 23*a* and 23*b* whereby solution 12 decreases in pH, as a function of neutralization, to a pH at which the cyan, magenta and yellow dye developers, in the reduced form, are substantially insoluble and nondiffusible, to thereby provide increased stability to the multicolor dye transfer image.

subsequent to distribution of processing solution 12, container 11, optionally, may be manually dissociated from the remainder of the film unit, as described above.

As previously stated, the multicolor dye transfer image is viewable through dimensionally stable transparent layer 24*b* both during and subsequent to transfer image formation, in the preferred embodiment detailed above.

The present invention will be further illustrated and detailed in conjunction with the following illustrative constructions which set out representative embodiments and photographic utilization of the novel photographic film units of this invention, which, however, are not limited to the details therein set forth and are intended to be illustrative only.

Film units similar to that shown in the drawings may be prepared, for example, by providing, in succession, on a first 4 mil. transparent polyester film base, the following layers:

1. the partial butyl ester of polyethylene/maleic anhydride copolymer at a coverage of about 2500 mgs./ft.$^2$ to provide a polymeric acid layer;

2. a timing layer containing about a 49:1 ratio of a 60/30/4/6 copolymer of butylacrylate, diacetone acrylamide, styrene and methacrylic acid and polyacrylamide at a coverage of about 500 mgs./ft.$^2$; and 3. a 2:1 mixture, by weight, of polyvinyl alcohol and poly-4-vinylpyridine, at a coverage of about 300 mgs./ft.$^2$ to provide a polymeric image-receiving layer;

4. a 25:1 mixture of titanium dioxide and a 60/30/4/6 copolymer of butyl acrylate, diacetone acrylamide, styrene and methacrylic acid at a coverage of about 1800 mgs./ft.$^2$;

5. gelatin at a coverage of about 120 mgs./ft.$^2$;

6. a 1:0.8:0.1 mixture of carbon black, Rhoplex E-32 (an acrylic latex sold by Rohm and Haas Co., Philadelphia, Pa., U.S.A.) and polyacrylamide at a coverage of about 240 mgs./ft.$^2$ measured as carbon;

7. a 1:1 mixture of (a) a solid dispersion of the cyan dye developer

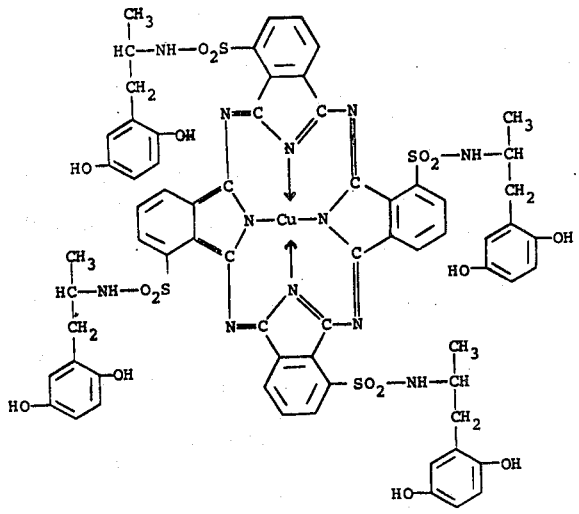

gelatin and polyvinyl hydrogen phthalate coated to provide a coverage of about 67 mgs./ft.$^2$ dye developer, about 97 mgs./ft.$^2$ of gelatin and about 5 mgs./ft.$^2$ of polyvinyl hydrogen phthalate and (b) a red-sensitive gelatino silver iodobromide emulsion possessing a mean particle size of about 1.4 $\mu$ coated to provide a coverage of about 67 mgs./ft.$^2$ silver iodobromide measured as silver and about 29 mgs./ft.$^2$ gelatin;

8. a red-sensitive gelatino silver iodobromide emulsion possessing a mean particle size of about 1.0 $\mu$ and polyvinyl hydrogen phthalate coated at a coverage of about 62 mgs./ft.$^2$ silver iodobromide measured as silver, about 60 mgs./ft.$^2$ gelatin and about 0.8 mgs./ft.$^2$ polyvinyl hydrogen phthhalate;

9. a layer of butyl acrylate/diacetone acrylamide/-styrene/methacrylic acid (60/30/4/6) and polyacrylamide coated in a ratio of about 29:1, respectively, at a coverage of about 162 mgs./ft.$^2$;

10. a 1:1 mixture of (a) a solid dispersion of the magenta dye developer

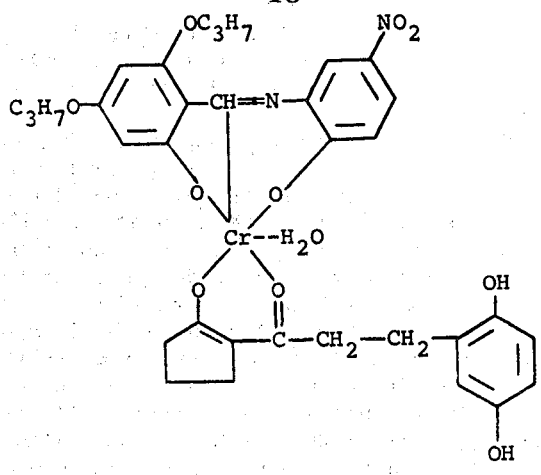

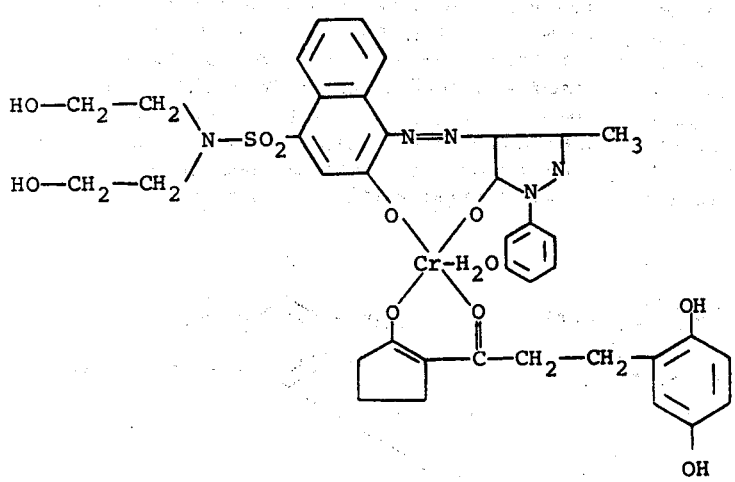

and gelatin coated to provide a coverage of about 100 mgs./ft.$^2$ of dye developer and about 87 mgs./ft.$^2$ of gelatin and (b) a green-sensitive gelatino silver iodobromide emulsion possessing a mean particle size of about 1.4 $\mu$ coated to provide a coverage of about 30 mgs./ft.$^2$ silver iodobromide measured as silver and about 22 mgs./ft.$^2$ gelatin;

11. a green-sensitive gelatino silver iodobromide emulsion possessing a mean particle size of about 1.0 $\mu$ and polyvinyl hydrogen phthalate coated at a coverage of about 40 mgs./ft.$^2$ silver iodobromide measured as silver, about 87 mgs./ft.$^2$ gelatin and about 1.3 mgs./ft.$^2$ polyvinyl hydrogen phthalate;

12. a layer of butyl acrylate/diacetone acrylamide/-styrene/methacrylic acid (60/30/4/6) and polyacrylamide coated in a ratio of about 29:4, respectively, at a coverage of about 110 mgs./ft$^2$ and succindialdehyde coated at a coverage of about 10 mgs./ft.$^2$;

13. a 1:1 mixture of (a) a solid dispersion of the yellow dye developer and gelatin coated to provide a coverage of about 120 mgs./ft.$^2$ dye developer and about 48 mgs./ft.$^2$ of gelatin; and (b) a blue-sensitive gelatino silver iodobromide emulsion possessing a mean particle size of about 1.4 $\mu$ and polyvinyl hydrogen phthalate coated to provide a coverage of about 50 mgs./ft.$^2$ silver iodobromide measured as silver, about 22 mgs./ft.$^2$ gelatin and about 0.3 mgs./ft.$^2$ polyvinyl hydrogen phthalate;

14. a blue-sensitive gelatino silver iodobromide emulsion possessing a mean particle size of about 1.0 $\mu$, polyvinyl hydrogen phthalate and 4′-methylphenyl hydroquinone in N,N-diethyl lauramide coated at a coverage of about 100 mgs./ft.$^2$ silver iodobromide measured as silver, about 66 mgs./ft$^2$ gelatin, about 0.6 mgs./ft$^2$ polyvinyl hydrogen phthalate and about 25 mgs./ft$^2$ 4′-methylphenyl hydroquinone;

15. a layer of gelatin coated at a coverage of about 40 mgs./ft.$^2$.

A second 4 mil. transparent polyester film base may then be taped to the photosensitive element in laminate form, at their respective lateral and trailing edges, by means of a pressure-sensitive binding tape extending around, in contact with, and over the edges of the resultant laminate.

A rupturable container comprising an outer layer of lead foil and an inner liner or layer of polyvinyl chloride retaining an aqueous alkaline processing solution such as, for example, about 0.8 cc. of 0.5 cc. of 1N sodium hydroxide and about 0.8 cc of water, about 100 cc. of 10.5 grams of potassium hydroxide, about 2.3 grams of carboxymethyl cellulose, about 95.6 grams of titanium dioxide, about 2.9 grams of N-benzyl-a-picolinium bromide, about 1.7 grams of N-phenethyl-α-picolinium bromide, about 1.7 grams of an aqueous silica dispersion comprising about 30 percent $SiO_2$, one or more antifoggants such as about 1.3 grams of benzotriazole and about 0.06 gram of 6-methyl-5-bromo-4-azabenzimidazole, about 0.67 gram of 6-methyl uracil, about 0.47 gram of bis-(β-aminoethyl)sulfide, about 0.94 gram of 6-benzyl-amino purine, about 1.22 grams of polyethylene glycol, about 1.9 grams of 1-hydroxyethyl-ethylene diamine tetra acetic acid, about 0.22 gram of lithium nitrate, and about 0.25 gram of lithium hydroxide may then be fixedly mounted on the leading edge of each of the laminates, by pressure-sensitive tapes interconnecting the respective containers and laminates, such that, upon application of compressive pressure to the container, its contents may be distributed, upon rupture of the container's marginal seal, between the second transparent polyester film base and its next adjacent layer 15.

The photosensitive composite film units may be exposed through radiation incident on the second transparent polyester film base and processed by passage of the exposed film units through appropriate pressure-applying members, such as suitably gapped, e.g., 50 to 60 mils, opposed rolls, to effect rupture of the container and distribution of its contents. Subsequent to processing, multicolor dye transfer image formation may be viewed through the first transparent polyester layer against a titanium dioxide reflection layer.

Film units, fabricated essentially as denoted above, may be processed in the stated manner, subsequent to exposure through a conventional step wedge, to provide graphic illustration of the characteristic curves of the respective dye transfer images forming the multicolor dye positive images. Specifically, the detailed characteristic curves may be determined by plotting the density of the respective images to red, green and blue light, as a function of the log exposure of the photosensitive element, e.g., the characteristic cyan, magenta and yellow transfer image dye curves (read to red, green and blue reflected light) of the test film units. Such characteristic curves may be compared with the characteristic curves of control film units prepared substantially as stated above deleting component (b) in each of Layers 7 and 10 and which comparisons will establish the advantages to be obtained by the present invention as more fully detailed hereinbefore.

By addition of an effective concentration of

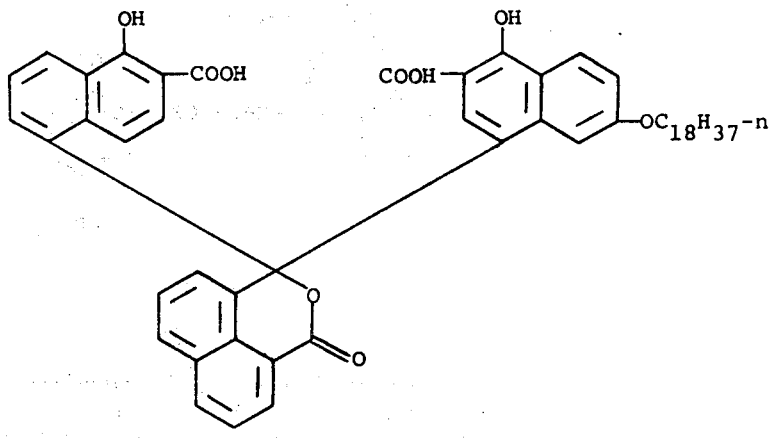

and

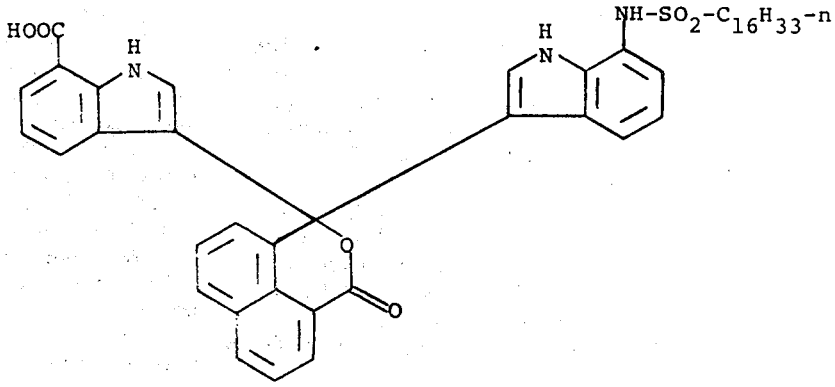

to the processing composition, for example, 6.17 and 1.37 grams, respectively, to the second processing composition component identified above, image formation in the second image-receiving layer may be immediately viewed upon distribution of the processing composition by reason of the protection against incident radiation afforded the photosensitive silver halide emulsion layers by the composition's optical transmission density of < about six density units and against the titanium dioxide's effective reflective background afforded by reason of the composition possessing an optical reflection density of < about one density units.

The pH and solvent concentration of the alkaline processing solution initially employed will preferably possess a pH above the pKa of the optical filter agents where the latter are employed, that is, the pH at which about 50 percent of the agents are present as the lesser absorbing species and about fifty percent are present as the greater absorbing species, preferably a pKa of > about 11 and most preferably > about 12 and a pH at which the dye developers employed are soluble and diffusible. Although it has been found that the specific pH to be employed may be readily determined empirically for any dye developer and optical filter agent, or group of dye developers and filter agents, most particularly desirable dye developers are soluble at pH's above 9 and relatively insoluble at pH's below 9, in reduced form, and the system can be readily balanced accordingly for such dye developers. In addition, although as previously noted, the processing composition, in the preferred embodiment, will include the stated film-forming viscosity-increasing agent, or agents, to facilitate spreading of the composition and to provide maintenance of the spread composition as a structurally stable layer of the laminate, subsequent to distribution, it is not necessary that such agent be employed as a component of the composition. In the latter instance, however, it will be preferred that the concentration of solvent, that is, water, etc., comprising the composition be the minimum amount necessary to conduct the desired transfer process, in order not to adversely effect the structural integrity of the laminate and that the layers forming the laminate can readily accommodate and dissipate the solvent throughout during processing and drying without effecting undesirable dimensional changes in the layers forming the laminate.

As disclosed in the previously cited patents, the liquid processing composition referred to for effecting multicolor diffusion transfer processes comprises at least an aqueous solution of an alkaline material, for example, diethylamine, sodium hydroxide or sodium carbonate and the like, and preferably possessing a pH in excess of 12, and most preferably includes a viscosity-increasing compound constituting a film-forming material of the type which, when the composition is spread and dried, forms a relatively firm and relatively stable film. The preferred film-forming materials disclosed comprise high molecular weight polymers such as polymeric, water-soluble ethers which are insert to an alkaline solution such as, for example, a hydroxyethyl cellulose or sodium carboxymethyl cellulose. Additionally, film-forming materials or thickening agents whose ability to increase viscosity is substantially unaffected if left in solution for a long period of time are also disclosed to be capable of utilization. As stated, the film-forming material is preferably contained in the processing composition in such suitable quantitites as to impart to the composition a viscosity in excess of 100 cps. at a temperature of approximately 24° C. and preferably in the order of 100,000 cps. to 200,000 cps. at that temperature.

Neutralizing means, for example, a polymeric acid layer of the type discussed above will be incorporated, as stated, in the film unit of the present invention, to provide reduction of the alkalinity of the processing solution from a pH at which the dyes are soluble as a function of film unit photoexposure and above the pKa of selected optical filter agents where desired to a pH below the pKa of the filter agent selected and at which the dyes are substantially nondiffusible, in order to advantageously further stabilize and optimize reflectivity of the respective dye transfer images. In such instance, the neutralizing layer may comprise particulate acid reacting reagent disposed within the film unit or a polymeric acid layer, for example, a polymeric acid layer approximately 0.3 to 1.5 mils in thickness, positioned intermediate the first and/or second transparent support and the next adjacent functional layer and the film unit may also contain a polymeric spacer or barrier layer, for example, approximately 0.1 to 0.7 mil in thickness, next adjacent the respective polymeric acid layer or layers, opposite the respective support layer, as previously described.

Specifically, the film units may employ the presence of a polymeric acid layer such as, for example, of the type set forth in U.S. Pat. No. 3,362,819 which, most preferably, includes the presence of an inert timing or spacer layer intermediate the polymeric acid layer carried on a support and the image-receiving layer.

As previously noted, the pH of the processing composition preferably is of the order of about least 12 to 14 and the pKa of the selected optical filter agents will accordingly preferably be in the order of 12 or greater. The polymer layer is disclosed to contain at least sufficient acid groups to effect a reduction in the pH of the image layer from a pH of about 12 to 14 to a pH of at least 11 or lower at the end of the imbibition period, and preferably to a pH of about 5 to 8 within a short time after imbibition, thus requiring, of course, that the action of the polymeric acid be accurately so controlled as not to interfere with either development of the negative or image transfer of unoxidized dye developers. For this reason, the pH of the image layer must be kept at a functional transfer level, for example, 12 to 14 until the dye image has been formed after which the pH is reduced very rapidly to a pH below that at which dye transfer may be accomplished, for example, at least about 11 and preferably about pH 9 to 10. Unoxidized dye developers containing hydroquinonyl developing radicals diffuse from the negative to the positive as the sodium or other alkali salt. The diffusion rate of such dye image-forming components thus is at least partly a function of the alkali concentration, and it is necessary that he pH of the image layer remain on the order of, for example, 12 to 14 until transfer of the necessary quantity of dye has been accomplished. The subsequent pH reduction, in addition to its desirable effect upon image light stability, serves a highly valuable photographic function by substantially terminating further dye transfer.

In order to prevent premature pH reduction during transfer processing, as evidenced, for example, by an undesired reduction in positive image density, the acid groups are disclosed to be so distributed in the polymer layer that the rate of their availability to the alkali is controllable, e.g., as a function of the rate of swelling of the polymer layer which rate in turn has a direct relationship to the diffusion rate of the alkali ions. The desired availability of the acid groups in the polymer layer may be effected by mixing acid polymer with a polymer free of acid groups, or lower in concentration of acid groups, and compatible therewith, as a modulated system, or by using only an acid polymer but selecting one having a predetermined acid group availability rate.

The layer containing the polymeric acid may also contain a water-insoluble polymer, preferably a cellulose ester, which acts to control or modulate the rate at which the alkali salt of the polymer acid is formed. As examples of cellulose esters contemplated for use, mention is made of cellulose acetate, cellulose acetate butyrate, etc. The particular polymers and combinations of polymers employed in any given embodiment are, of course, selected so as to have adequate wet and dry strength and when necessary or desirable, suitable subcoats are employed to help the various polymeric layers adhere to each other during storage and use.

The inert spacer layer of the last-mentioned patent, for example, an inert spacer layer comprising polyvinyl alcohol or gelatin, acts to "time" control the pH reduction by the polymeric acid layer. This timing is disclosed to be a function of the rate at which the alkali diffuses through the inert spacer layer. It is there stated to have been found that the pH does not drop until the alkali has passed through the spacer layer, i.e., the pH is not reduced to any significant extent by the mere diffusion into the interlayer, but the pH drops quite rapidly once the alkali diffuses through the spacer layer.

As disclosed in aforementioned U.S. Pat. No. 3,362,819, the presence of an inert spacer layer was found to be effective in evening out the various reaction rates over a wide range of temperatures, for example, by preventing premature pH reduction when imbibition is effected at temperatures above room temperature, for example, at 95° to 100° F. By providing an inert spacer layer, that application discloses that the rate at which alkali is available for capture in the polymeric acid layer becomes a function of the alkali diffusion rates.

However, as disclosed in U.S. Pat. No. 3,455,686, preferably the aforementioned rate at which the cations of the alkaline processing composition, i.e., alkali ions, are available for capture in the polymeric acid layer should be decreased with increasing transfer processing temperatures in order to provide diffusion transfer color processes relatively independent of positive transfer image variations over an extended range of ambient temperatures.

Specifically, it is there stated to have been found that the diffusion rate of alkali through a permeable inert polymeric spacer layer increases with increased processing temperature to the extent, for example, that at relatively high transfer processing temperatures, that is, transfer processing temperatures above approximately 80° F., a premature decrease in the pH of the transfer processing composition occurs due, at least in part, to the rapid diffusion of alkali from the dye transfer environment and its subsequent neutralization upon contact with the polymeric acid layer. This was stated to be especially true of alkali traversing an inert spacer layer possessing permeability to alkali optimized to be effective with the temperature range of optimum transfer processing. Conversely, at temperatures below the optimum transfer processing range, for example, temperatures below approximately 40° F., the last-mentioned inert spacer layer was disclosed to provide an effective diffusion barrier timewise preventing effective traverse of the inert spacer layer by alkali having temperature depressed diffusion rates and to result in maintenance of the transfer processing environment's high pH for such an extended time interval as to facilitate formation of transfer image stain and its resultant degradation of the positive transfer images' color definition.

It is further stated in the last-mentioned U.S. Pat. No. 3,455,686 to have been found, however, that if the inert spacer layer of the print-receiving element is replaced by a spacer layer which comprises a permeable polymeric layer exhibiting permeability inversely dependent on temperature, that is, a polymeric film-forming material which exhibits decreasing permeability to solubilized alkali derived cations such as alkali metal and quaternary ammonium ions under conditions of increasing temperature, that the positive transfer image defects resultant from the aforementioned overextended pH maintenance and/or premature pH reduction are obviated.

As examples of materials, for use as the imagereceiving layer, mention may be made of solution dyeable polymers such as nylon as, for example, N-methoxymethyl polyhexamethylene adipamide; partially hydrolyzed polyvinyl acetate; polyvinyl alcohol with or without plasticizers; cellulose acetate with filler as, for example, one-half cellulose acetate and one-half oleic acid; gelatin; and other materials of a similar nature. Preferred materials comprise polyvinyl alcohol or gelatin containing a dye mordant such as poly-4-vinylpyridine, as disclosed in U.S. Pat. No. 3,148,061, issued Sept. 8, 1964.

It will be noted that the liquid processing composition employed may contain an auxiliary or accelerating developing agent, such as p-methylaminophenol, 2,4-diaminophenol, p-benzylaminophenyl, hydroquinone, toluhydroquinone, phhenylhydroquinone, 4'-methylphenylhydroquinone, etc. It is also contemplated to employ a plurality of auxiliary or accelerating developing agents, such as a 3-pyrazolidone developing agent and a benzenoid developing agent, as disclosed in U.S. Pat. No. 3,039,869, issued June 19, 1962. As examples of suitable combinations of auxiliary developing agents, mention may be made of 1-phenyl-3-pyrazolidone in combination with p-benzylaminophenol and 1-phenyl-3-pyrazolidone in combination with 2,5-bis-ethylenimino-hydroquinone. Such auxiliary developing agents may be employed in the liquid processing composition or they may be initially incorporated, at least in part, in any one or more of the silver halide emulsion strata, the strata containing the dye developers, the interlayers, the image-receiving layer, or in any other auxiliary layer, or layers, of the film unit.

It may be noted that at least a portion of the dye developer oxidized during development may be oxidized and immobilized as a result of a reaction, e.g., an energy-transfer reaction, with the oxidation product of an oxidized auxiliary developing agent, the latter developing agent being oxidized by the development of exposed silver halide. Such a reaction of oxidized developing agent with unoxidized dye developer would regenerate the auxiliary developing agent for further reaction with the exposed silver halide.

In addition, development may be effected in the presence of an onium compound, particularly a quaternary ammonium compound, in accordance with the processes disclosed in U.S. Pat. No. 3,173,786, issued Mar. 16, 1965.

It will be apparent that the relative proportions of the agents of the diffusion transfer processing composition may be altered to suit the requirements of the operator. Thus, it is within the scope of this invention to modify the herein described developing compositions by the substitution of preservatives, alkalies, etc., other than those specifically mentioned, provided that the pH of the composition is initially at the first pH required. When desirable, it is also contemplated to include, in the developing composition, components such as restrainers, accelerators, etc. Similarly, the concentration of various components may be varied over a wide range and when desirable adaptable components may be disposed in the photosensitive element, prior to exposure, in a separate permeable layer of the photosensitive element and/or in the photosensitive emulsion.

The dimensionally stable layers or sheets referred to may comprise any of various types of conventional transparent rigid or flexible materials, for example, papers and polymeric films of both synthetic types and those derived from naturally occurring products. Suitable materials include alkaline solution impermeable materials such as polymethacrylic acid methyl and ethyl esters; vinyl chloride polymers, polyvinyl acetal; polyamides such as nylon; polyesters such as polymeric films derived from ethylene glycol and terephthalic acid; and cellulose derivatives such as cellulose acetate, triacetate, nitrate, propionate, butyrate, acetate-propionate or acetate-butyrate. It will be recognized that one or more or the designated layers may not be required where the remaining layers of the laminate are such as to provide the functions of these layers in the absence of same, for example, where the remaining layers of the laminate provide the requisite dimensional stability and radiation filtering properties.

In all examples of this specification, percentages of components are given by weight unless otherwise indicated.

Although the invention has been discussed in detail throughout employing dye developers, the preferred image-providing materials, it will be readily recognized that other, less preferred, diffusion transfer process dye image-providing materials may be substituted in replacement of the preferred dye developers in the practice of the invention. For example, there may be employed dye image-forming materials such as those disclosed in U.S. Pat. Nos. 2,647,049; 2,661,293; 2,698,244; 2,698,798; 2,802,735; 3,148,062; 3,227,550; 3,227,551; 3,227,552; 3,227,554; 3,243,294; 3,330,655; 3,347,671; 3,352,672; 3,364,022; 3,443,939; 3,443,940; 3,443,941; 3,443,943; etc., wherein color diffusion transfer processes are described which employ color coupling techniques comprising, at least in part, reacting one or more dye image-providing color developing agents and one or more dye image-providing color formers or couplers to provide a dye transfer image to a superposed image-receiving layer and those disclosed in U.S. Pat. Nos. 2,774,668 and 3,087,817, wherein color diffusion transfer processes are described which employ the imagewise differential transfer of complete dyes by the mechanisms therein described to provide a transfer dye image to a contiguous image-receiving layer, and thus including the employment of dye image-providing materials in whole or in part initially insoluble or non-diffusible as disposed in the film unit which diffuse during processing as a direct or indirect function of exposure.

Where desired, the film unit may also contain ultraviolet absorbing materials to protect the mordanted dye transfer image from fading due to ultraviolet light such as those selected from the general class of benzotriazoles and benzophenones as, for example, the substituted 2-phenyl-benzotriazole agents disclosed in U.S. Pat. Nos. 3,004,896; 3,189,615; etc.; the 2-hydroxybenzophenones such as 2-hydroxy-4-methoxybenzophenone; 2,2′-dihydroxy-4-methoxybenzophenone; 2-hydroxy-4-octyloxybenzophenone; etc.; both water and organic solvent soluble agents being contemplated, and/or brightening agents such as those selected from the general class of triazinestilbenes, coumarins, anthracenes, terphenyls, tetraphenylbutadienes, quinoxalines, conventional for use as fluorescent agents and as optical brightening agents. Suitable triazenestilbene optical brightening agents are disclosed in U.S. Pat. No. 2,933,390; coumarines are disclosed in British Pat. No. 786,234; and various agents are disclosed in U.S. Pat. Nos. 2,171,427; 2,473,475; 2,595,030; 3,660,578; and British Pat. Nos. 595,065; 623,849; 624,051; 624,052; 678,291; 681,642; 705;406; etc. Commercially available brightening agents are distributed under the trade designation Tinopal (SP, WR, SFG, BV277, 2B, GS, NG) Leucophor B, Calcoflour White MR, Blaneofor SC, Hitamine (BSP, N, SOL., 6T6), and the like, and commercially available ultraviolet absorbing agents are distributed under the trade designation Tinuvin and the like.

In general, ultraviolet absorbing and optical brightening agents may be employed in concentrations varying over an extended range. Suitable concentrations include those within the range of about 0.2 to 10 mgs./ft.$^2$ of receptor layer surface area and, preferably, between about 1 to 5 mgs./ft.$^2$.

The agents may be incorporated in any one or more of the layers of the film unit preferably intermediate an opaque layer forming the background against which an image is viewed and the viewing surface in any suitable manner as, for example, a constituent component of the casting and/or coating solution or formulation employed to provide such layer or layers employing an organic solvent or water carrier or as a latex dispersion.

In the circumstances wherein the receptor layer or layers possess the dimensional stability to provide a self-sustaining layer conformation, the layer may optionally be coated on or carried by an appropriate dimensionally stable support layer of the various types and classes specifically designated hereinbefore or not at the election of the operator.

Ordinarily, when the image receptor stratum comprises a layer carried on a separate dimensionally stable support layer, the receptor stratum will comprise in the order of about 0.1 to 0.4 mil in thickness whereas such stratum employed as a self-sustaining layer will comprise in the order of about 3 to 6 mils in thickness.

In addition to conventional techniques for the direct dispersion of a particulate solid material in a polymeric, or colloidal, matrix such as ball-milling and the like techniques, the preparation of the dye developer and color coupler dispersions may also be obtained by dissolving the dye and/or coupler in an appropriate solvent, or mixture of solvents, and the resultant solution distributed in the polymeric binder, with optional subsequent removal of the solvent, or solvents, employed, as, for example, by vaporization where the selected solvent, or solvents, possesses a sufficiently low boiling point or washing where the selected solvent, or solvents, possesses a sufficiently high differential solubility in the wash medium, for example, water, when measured against the solubility of the remaining composition components, and/or obtained by dissolving both the polymeric binder and dye in a common solvent.

For further detailed treatment of solvent distribution systems of the types referred to above, and for an extensive compilation of the conventional solvents traditionally employed in the art to effect distribution of photographic color-providing materials in polymeric binders, specifically for the formation of component layers of photographic film units, reference may be made to U.S. Pat. Nos. 2,269,158; 2,322,027; 2,304,939; 2,304,940; 2,801,171; and the like.

Although the preceding description of the invention has been couched in terms of the preferred photosensitive component construction wherein at least two selectively sensitized photosensitive strata are in contiguous coplanar relationship and, specifically, in terms of the preferred tripack type structure comprising a red-sensitive silver halide emulsion stratum, a green-sensitive silver halide emulsion stratum and a blue-sensitive silver halide emulsion stratum having associated therewith, respectively, a cyan dye developer, a magenta dye developer and a yellow dye developer, the photosensitive component of the film unit may comprise at least two sets of selectively sensitized minute photosensitive elements arranged in the form of a photosensitive screen wherein each of the minute photosensitive elements has associated therewith, for example, an appropriate dye image-forming material in or behind its respective silver halide emulsion portion. In general, a suitable photosensitive screen may comprise minute red-sensitized emulsion elements, minute green-sensitized emulsion elements and minute blue-sensitized emulsion elements arranged in side-by-side relationship in a screen pattern and having associated therewith, respectively, for example, a cyan, a magenta and a yellow dye developer.

The present invention also includes the employment of a black dye image-providing material and the use of a mixture of, for example, dye developers adapted to provide a black-and-white transfer image, for example, the employment of dye developers of the three subtractive colors in an appropriate mixture in which the quantities of the dye developers are proportioned such that the colors combine to provide black.

Where in the specification, the expression "positive image" has been used, this expression should not be interpreted in a restrictive sense since it is used primarily for purposes of illustration, in that it defines the image produced on the image-carrying layers as being reversed, in the positive-negative sense, with respect to the image in the photosensitive emulsion layers. As an example of an alternative meaning for "positive image", assume that the photosensitive element is exposed to actinic light through a negative transparency. In this case, the latent image in the photosensitive emulsion layers will be a positive and the dye image produced on the image-carrying layers will be negative. The expression "positive image" is intended to cover such an image produced on the image-carrying layer.

In addition to the described essential layers, it will be recognized that the film unit may also contain one or more subcoats or layers, which, in turn, may contain one or more additives such as plasticizers, intermediate essential layers for the purpose, for example, of improving adhesion, and that any one or more of the described layers may comprise a composite of two or more strata of the same, or different, components and which may be contiguous, or separated from, each other, for example, two or more neutralizing layers or the like.

Where desired sheet 24*a*, illustrated in the figures as transparent and superposed coextensive the exposure surface of the photosensitive laminate in the preferred embodiment, may be adapted to be superposed on the laminate subsequent to photoexposure of the film unit as, for example, by fixedly positioning a leading edge of the sheet extending transverse a leading edge of the photosensitive laminate and adapted to be superposed, subsequent to photoexposure, on and coextensive the exposure surface of the laminate, at least during processing, to facilitate distribution of processing composition upon, for example, rupture of the container and unidirectional discharge of its processing composition contents contiguous the exposure surface of the laminate. In such embodiment the displaceable sheet may be transparent or opaque and the processing composition may or may not retain opacifying agent, at the election of the operator. Subsequent to distribution of the processing composition, the sheet may be manually dissociated from the remainder of the film unit individually and/or in combination with the processing composition employed and/or the expanded processing composition rupturable container.

In accordance with the present invention, the preferred form of the film assemblage for the production of a dye reflection print comprises a photosensitive film unit constructed as described above and specifically adapted to be processed in the presence of ambient radiation and the dye reflection print image to be viewed during and subsequent to processing without separation of film unit components and includes leader means for coupling film units and selectively withdrawing the units sequentially from a film pack or magazine and opacifying agent, preferably disposed in whole or in part in the processing composition, taken together with the opaque layer, adapted to prevent exposure of the first sheet element's photoresponsive material by radiation actinic thereto incident on the film unit in the processing mode.

A preferred form of film pack or magazine embodying the designated film units comprises a plurality of the film assemblies, each adapted to be individually exposed in a camera, enclosed in an initially light-proof container which allows the film units to be sequentially exposed. The container includes a forward wall having a light-transmitting section, e.g., an exposure aperture, therein and an opening in one wall through which film assemblies can be individually withdrawn. The photosensitive film units are positioned together in stacked relationship within the container underlying the exposure aperture with the exposure surface of each film unit uppermost and the rupturable container positioned adjacent the opening through which the film units are withdrawn so that following the exposure of each film unit, the unit is moved, by drawing on the leader of the film unit, and withdrawn from the container through the opening. The film pack is initially provided with a cover element or sheet mounted within the container and extending across the exposure aperture for closing the aperture against the admission of light. The cover element also includes a leader extending from the container through the opening and being removable therethrough.

The film pack is employed by being positioned in a camera, including a pair of juxtaposed pressure-applying members, with the opening located adjacent the pressure-applying members and the exposure aperture disposed approximately in the exposure plane of the camera. A leader for the cover element extends from the pack and from the camera where the last-mentioned leader may be grasped for withdrawing the cover element from the pack through the pressure-applying members and camera to allow the film units of the pack to be selectively exposed. After each successive film unit is exposed, that film unit is then individually withdrawn from the container and camera between the pressure-applying members by withdrawing the leader of the first film unit and of successive film units from the container and camera.

Figure 9:
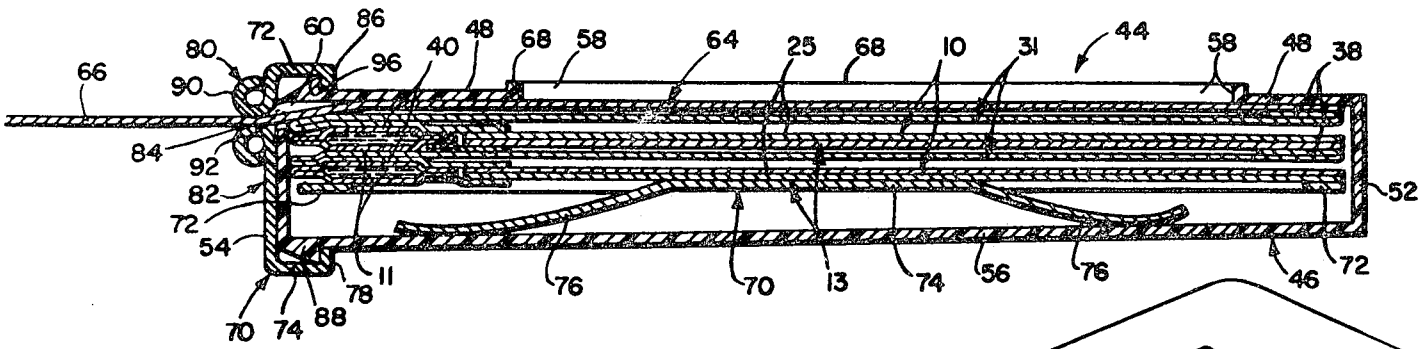
FIG. 9 is a longitudinal sectional view taken substantially midway between the sides of the film pack of FIG. 8.
Figure 8:
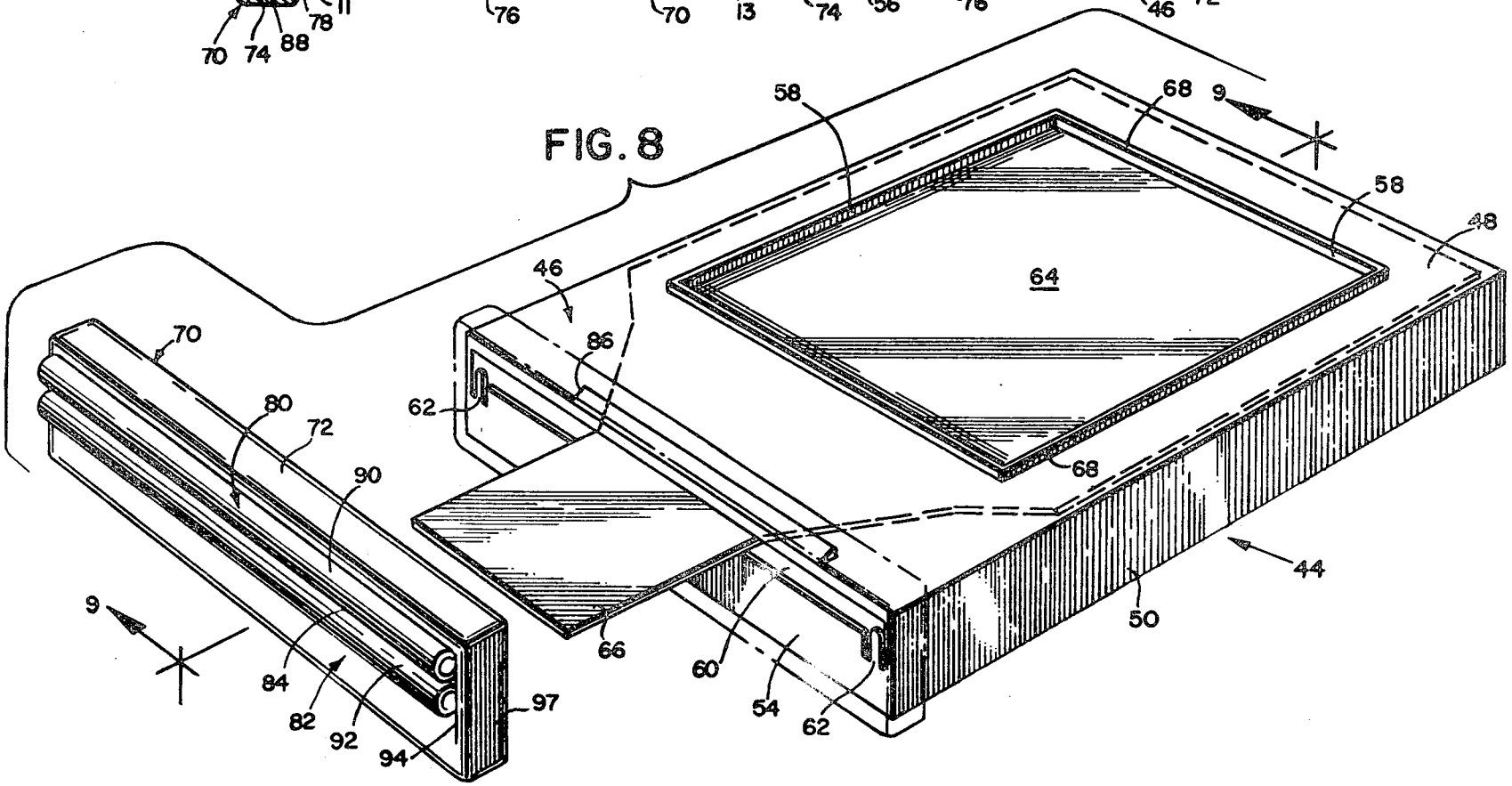
FIG. 8 is a perspective view of a film pack comprising an assemblage of film units.

Reference is now made to FIGS. 1, 8 and 9 of the drawings wherein there are illustrated film units and an assemblage of film units in the form of a film pack. Each film unit 10 includes a leader sheet 31 having a leading end section designated 38 and a trailing end section 40 at which the leader sheet 31 is coupled with the film unit near the leading end thereof. Leader sheet 31 including leading and trailing end sections 38 and 40 is approximately equal in width to the film unit 10 and leading end section 38 of each leader sheet 31 is secured to the trailing end of the next preceding film unit or, in the case of the first film unit, to the cover sheet, preferably near the trailing end section of the preceding element (cover sheet or film unit). The length of leader sheet 31 between its leading edge attachment to one film unit and the trailing edge to the next succeeding film unit is substantially equal to the length of the film units between their leading and trailing edges; and the connected film units and leaders are arranged in zig-zag folded relation.

A film pack or assemblage of film units 10 embodying the invention is shown in FIGS. 8 and 9 of the drawings. This film pack, designated 44, comprises all of the components and structure including pressure-applying means required to produce a plurality of diffusion transfer process color prints. Film pack 44 comprises a generally parallelepipedshaped container or box 46 for holding and enclosing a plurality of film units 10 arranged in stacked relation. Container 46 is shown as comprising a forward wall 48, side walls 50, a trailing end wall 52, a leading end wall 54, and a rear wall 56 and is preferably formed of plastic material that is at least semi-rigid and adapted to conventional molding techniques. Forward wall 48 is provided with a generally rectangular exposure aperture 58 for transmitting light for exposing the forwardmost of the film units carried in stacked relation within the container. Leading end wall 54 is provided with a generally rectangular withdrawal slot or exit opening 60 the forward edge of which is defined by forward wall 48 and through which film units 10 carried by the container are adapted to be withdrawn one at a time following exposure. In order to help insure that only one film unit at a time passes through opening 60, restraining means in the form of one or more projections or extensions 62 of end wall 54 may be provided. Projections 62, which as illustrated are integral parts of end wall 54, project forwardly part way across opening 60 to positions whereat they suffuciently obstruct the opening to the extent that they must be deformed in order to permit the passage of the forwardmost film unit in the stack, that is, the film unit positioned for exposure across aperture 58 against forward wall 48. Projections 62 comprise a resilient construction such that as the leading film unit is withdrawn through opening 60, the leading edge of the film unit will engage and deflect projections 62 outward sufficiently to permit the forward film unit only to move through slot 60, while preventing the next succeeding film unit from moving through the slot.

The film pack of the invention is initially provided with a dark slide or cover sheet 64 formed of an actinic light-impermeable sheet material for preventing admission of light through exposure aperture 58 prior to loading of the film pack into a camera or attachment of the film pack to the rear of the camera. Cover sheet 64 includes a section at least coextensive in area with forward wall 48 for preventing the admission of light and a leading end section 66 which may be tapered, as shown, extending from the film pack and providing a leader which may be grasped for manually withdrawing the cover sheet from the film pack to permit exposure of film units arranged in stacked relation underlying the exposure opening and cover sheet. A lip 68 is provided on forward wall 48 surrounding opening 58 for cooperating with the camera to properly locate the film pack and exposure opening therein with respect to the exposure systems of the camera and in instances where the film pack is coupled to the rear of the camera rather than being completely enclosed therein, lip 68 also cooperates to form a light-tight seal between the interior of the camera and the interior of the film pack container.

As previously noted, the film units 10 are arranged in stacked relation between the forward and rear walls of the film pack with sheets **24*a* facing forwardly and the exposure areas of the film units aligned with exposure opening 58. Means are provided for resiliently biasing the film units 10 and cover sheet 64 forwardly against the rear surface of forward wall 48 to light-seal the exposure aperture when the cover sheet is in place and following cover sheet removal, locate the forwardmost film unit in proper position for exposure in the image plane of the camera, i.e., against the rear surface of forward wall 48. These means include a spring and pressure plate assembly designated 70, preferably formed of resilient sheet metal and including a generally rectangular frame 72 for engaging and supporting the rearwardmost film unit and a transverse portion 74 from which extend rearwardly biased spring sections 76** engaged with the rear wall 56 of the film pack for biasing frame 72 and the film units supported thereby, forwardly toward forward wall 48.

As previously noted, each film unit 10 includes a leader 31 attached at its trailing end 40 to the forward surface of the film unit near the leading end thereof. The film units and leaders are arranged in the film pack container with the trailing end of each leader 31 folded back upon itself so that the leader extends toward the trailing end of the film unit and pack container between the forward surface of the film unit of which it is a component and the rear surface of the cover sheet 64 (in the case of the forwardmost film unit) or the rear surface of the preceding film unit next adjacent forward wall 48 and exposure aperture 58. The leading end 38 of each leader is folded forwardly upon itself and attached to the rear surface of the component, i.e., cover sheet 64 or film unit 10, located next adjacent the forward wall and is secured to said component near the trailing end thereof. Thus the cover sheet 64 and succession of film units 10 are joined by leaders 31, each of which extends from the trailing end of the component to the leading end of the next component (film unit) to be withdrawn from the pack. The leaders 31 are folded in zig-zag fashion to provide a stack comprising cover sheet 64, a leader 31, a film unit 10, another leader 31, and so forth. Each leader 31 may be weakened by perforations, precutting, or the like so that the portion of a leader attached to a film unit within the pack and extending from the pack to provide a leader for withdrawing the last-mentioned film unit may be severed from the portion of the leader attached to the preceding component, i.e., cover sheet 64 or film unit 10.

In accordance with the invention, film pack 44 includes means for compressively engaging each film unit as it is withdrawn therefrom following exposure, to rupture container 11 causing the discharge of its liquid contents intermediate layers 21*a* and 15 and spread the liquid contents of the container as a thin layer between the aforementioned layers. As shown in FIGS. 8 and 9, these pressure-applying means take the form of an integral pressure-applying unit or device 70 coupled to box 46 at the leading end thereof. Pressure-applying device 70 is preferably formed of a sheet material such as metal which is both structurally strong and rigid while having flexibility sufficient to accommodate the varying thickness of a film unit as the latter is withdrawn from the film pack. Device 70 is shown as having a generally parallelepiped shape including a forward wall 72, rear wall 74 and side walls 97 adapted to encompass the leading end portion of the forward, rear and side walls of container 46, to provide additional strength and rigidity and to cooperate in retaining pressure-applying device 70 on box 46 as a component of film pack 44. Forward wall 72 is provided with a rearwardly extending dependent lip 96 and rear wall 74 is provided with a forwardly extending dependent lip 78. The spreading device includes a leading end wall including a forward section 80 and a rear section 82 separated from one another by a withdrawal opening or passage. Forward section 80 and rear section 82 include edge portions rolled upon themselves to form cylinders or pressure-applying members designated 90 and 92, respectively, having substantial resistance to flexure or bending and adapted to function as a pair of pressure-applying members.

Lips 96 and 78 are engaged with ridges 86 and 88 formed on the leading end portions of forward wall 48 and rear wall 56, respectively, of the film pack container 46. Ridges 86 and 88 are inclined or tapered toward the leading end of the film unit to facilitate coupling of the pressure applying device 70 to the film pack container simply by pressing the pressure-applying device onto the end of the container slightly deforming the forward and rear walls of the container and/or pressure-applying device as required to permit lips 96 and 78 to pass over the ridges 86 and 88 into the position shown in FIG. 9 in which the rear portion of forward wall 82 is disposed against end wall 54 of the film pack container.

As previously noted, and as will be apparent from the drawings, the minimum or compressed thickness of the film unit will vary throughout the length of the film unit so that the depth of the gap or passage 84 between pressure-applying members 90 and 92 should be variable so that the pressure-applying members apply compressive pressure regardless of the variation in the film unit thickness. To facilitate relative movements of the cylindrical pressure-applying members which are preferably located with their axis parallel and coplanar, rear portion 82 is formed with slits 94 at the ends of cylindrical pressure-applying members 92 to facilitate movement of member 92 relative to pressure-applying member 90 toward and away from the latter.

While a zig-zag folded arrangement of interconnected leaders and film units is illustrated, it should be understood that means other than those shown in the drawings may be provided for assisting in the manual withdrawal of the film units, one at a time, from the film pack between the pressure-applying members. Such means are disclosed, for example, in U.S. Pat. Nos. 2,903,951; 2,909,977; and 2,946,270. Other systems in which a leader of one film unit is withdrawn from the pack to a position at which it can be gripped by and in response to withdrawal of the previous film unit or the cover sheet are also well known in the art and can be employed in place of the leader system shown.

It will be seen from the foregoing that the invention provides a simple and inexpensive film pack structure including all of the components required to produce a plurality of color prints; and that such prints are produced simply and easily by manually withdrawing exposed film units one at a time from the pack between a pair of pressure-applying members which are an integral part of the pack. The only other (external) structure required in order to produce color prints is an exposure system including, for example, a lens, shutter, view finder, etc. in conjunction with which the pack is adapted to be employed. Each film unit comprises an integral unit which remains intact prior to, during and subsequent to exposure and processing so that the only manipulative step is film unit withdrawal which is effective to discharge the processing liquid contents of a container within the film unit distribute the processing liquid therewithin so as to effect dye transfer image formation while the film unit is outside of the pack, and of the camera if the pack is enclosed therein.

Withdrawal of each film unit 10 in effect succeeds in projecting leader 31 secured to the next succeeding film unit through passage 71 for the distance necessary to selectively withdraw that film unit for processing subsequent to photoexposure in the manner state above. Where desired the leader may be selectively detached from the preceding and succeeding film unit subsequent to the selected film units' withdrawal from the camera.

It will be recognized that although in the preferred embodiment of the present invention the leading end section 38 of the leader sheet 31 is secured to either major surface of the preceding elements trailing end section provided that by position or composition when secured to the exposure surface it does not interfere with exposure of the unit. Leading end section 38 of leader sheet 31 may be secured to the preceding element, i.e., film unit or dark slide, on its surface opposite the exposure aperture forward that element's trailing end section provided that the length of the leader is sufficient to extend through the withdrawal orifice a sufficient distance to be grasped, possesses the requisite slip capacity, e.g., by composition or coating, to allow its withdrawal from the cassette including between the opposed pressure-applying members and is readily dissociated from the preceding element external the camera and within grasping capacity of the operator.

The dark slide and leader sheet materials employed may comprise any one or more of the conventional paper and/or polymeric materials, for example, those previously identified, sufficiently flexible to perform the function denoted with respect to the leader material, be opaque, translucent or transparent, and may optionally be either separated from the flm unit subsequent to processing, for example, with or without separation of the frangible container, or alternatively adhered to either film unit surface, and where transparent, to the viewing surface, of the film unit, preferably coextensive therewith for aesthetic purposes by means of conventional selectively adhering adhesives available from a multiplicity of commercial sources which may be carried by a proposed contact surface. In those instances wherein the leader is maintained with the processed film unit, the decorative aspects of the leader sheet, i.e., color, texture and design will be selected to provide the desired visual appearance.

Since certain changes may be made in the above produce without departing from the scope of the invention herein involved, it is intended that all matter contained in the above description or shown in the accompanying drawings shall be interpreted as illustrative and not in a limiting sense.

What is claimed is:

1. A composite photographic diffusion transfer process film unit which comprises a plurality of sequential layers including, in combination, a first dimentionally stable transparent layer; a first dyeable layer adapted to receive diffusion transfer process dye image-forming material diffusing thereto; an opaque layer; a first photosensitive silver halide layer comprising a dispersion of silver halide grains possessing a first mean particle size, having associated therewith a diffusion transfer process dye image-forming material possessing spectral absorption within the spectral range to which the silver halide grains are sensitive; a second photosensitive silver halide layer substantially free of diffusion transfer process dye image-forming material comprising a dispersion of silver halide grains possessing a second mean particle size and substantially spectrally sensitive within said spectral range; said second mean particle size being less than said first particle size; a second dimensionally stable transparent layer; means for providing a processing composition intermediate the second dimensionally stable transparent layer and the next adjacent silver halide layer; means for providing opacifying agent intermediate the second dimensionally stable layer and the next adjacent silver halide layer in a quantity effective to prevent exposure of the photosensitive silver halide layers during processing of the film unit in the presence of radiation actinic to the photosensitive layers and incident on said second dimensionally stable transparent layer and the opaque layer is effective to prevent exposure of said photosensitive layers during processing of said film unit in the presence of radiation actinic to the photosensitive layer and incident on said first dimensionally stable layer; means for maintaining the composite unit intact subsequent to diffusion transfer processing; said second silver halide layer possessing a sensitivity to incident radiation at wavelengths to which it has been sensitized greater than the sensitivity exhibited by said first photosensitive silver halide layer to said radiation at said wavelengths; said layers arranged in substantially parallel planar relationship; and said dimensionally stable layers being externally disposed with respect to the other of said layers.

2. A composite photographic diffusion transfer color process film unit as defined in claim 1 wherein said processing composition possesses a first processing pH and said film unit includes means for converting, subsequent to substantial dye transfer image formation in said dyeable layer, said processing composition from said first processing pH to a second pH at which each of said dye transfer images exhibit increased stability.

3. A composite photographic diffusion transfer process film unit as defined in claim 2 wherein said first processing pH is an alkaline pH and said second pH is lower than said first pH.

4. A composite photographic diffusion transfer process film unit as defined in claim 3 wherein said second pH is > one pH unit less than said first pH.

5. A composite photographic diffusion transfer process film unit as defined in claim 2 wherein said means for converting said processing composition from said first to said second pH subsequent to substantial dye transfer image formation in said first dyeable layer comprises a polymeric neutralizing layer positioned intermediate at least one of said first dimensionally stable transparent layer and said dyeable layer, and said second dimensionally stable transparent layer and said next adjacent silver halide layer.

6. A composite photographic diffusion transfer process film unit as defined in claim 1 wherein said opaque layer is actinic radiation reflective.

7. A composite photographic diffusion transfer process film unit as defined in claim 6 wherein said opaque layer comprises titanium dioxide dispersed in a processing composition permeable polymeric binder.

8. A composite photographic diffusion transfer process film unit as defined in claim 7 wherein said opaque layer comprises a composite including a layer containing carbon black dispersed in a processing composition permeable polymeric binder positioned intermediate said opaque layer comprising titanium dioxide and the photosensitive silver halide layer next adjacent thereto.

9. A composite photographic diffusion transfer process film unit as defined in claim 1 wherein said opacifying agent is actinic radiation absorptive.

10. A composite photographic diffusion transfer process film unit as defined in claim 9 wherein said opacifying agent comprises an inorganic pigment.

11. A composite photographic diffusion transfer process film unit as defined in claim 10 wherein said opacifying agent including said inorganic reflecting pigment is disposed in said processing composition.

12. A composite photographic diffusion transfer process film unit as defined in claim 1 wherein said means for providing said processing composition comprises rupturable container means retaining said processing composition extending transverse an edge of said film unit to effect, upon application of compressive pressure to the container means, discharge of said container means processing composition contents intermediate said second dimensionally stable transparent layer and the next adjacent silver halide layer.

13. A composite photographic diffusion transfer process film unit as defined in claim 1 wherein said diffusion transfer process dye image-forming material is a dye which is a silver halide developing agent.

14. A composite photographic diffusion transfer process film unit as defined in claim 13 wherein said dye is soluble and diffusible at a first pH and substantially nondiffusible at a second pH.

15. A composite photographic diffusion transfer process film unit as defined in claim 1 wherein said second photosensitive silver halide layer comprises a particulate dispersion of photosensitive silver iodochlorobromide, silver iodochloride or silver iodobromide grains.

16. A composite photographic diffusion transfer process film unit as defined in claim 15 wherein said dispersion comprising said photosensitive silver iodochlorobromide, silver iodochloride or silver iodobromide dispersion possesses a mean grain size within the range of about 0.2 to 3.0 $\mu$.

17. A composite photographic diffusion transfer process film unit as defined in claim 16 wherein each of said first and second photosensitive silver halide layers comprises photosensitive silver iodochlorobromide, silver iodochloride or silver iodobromide grains.

18. A process for providing a composite photographic diffusion transfer process dye image which comprises, in combination, the steps of:

a. exposing to incident actinic radiation a photographic diffusion transfer process film unit which comprises, a plurality of sequential layers including in combination, a dimensionally stable transparent layer; a dyeable layer adapted to receive diffusion transfer process dye image-forming material diffusing thereto; an opaque layer; a first photosensitive silver halide layer comprising a dispersion of silver halide grains possessing a first mean particle size and having associated therewith a diffusion transfer process dye image-forming material possessing spectral absorption within the spectral range to which the silver halide layer is sensitive; a second photosensitive silver halide layer comprising a dispersion of silver halide grains possessing a mean particle size less than said first mean particle size, substantially spectrally sensitive within said spectral range, and substantially free of diffusion transfer process dye image-forming material; a second dimensionally stable transparent layer; said second silver halide layer possessing a sensitivity to incident radiation at wavelengths to which it has been sensitized in excess of the sensitivity exhibited by said first photosensitive silver halide layer to said radiation at said wavelengths; said layers arranged in substantially parallel planar relationship; and said dimensionally stable layers being externally disposed with respect to the other of said layers;

b. contacting the silver halide layers with a processing composition and effecting development of the photoexposed silver halide layers and formation of an imagewise distribution of mobile dye image-forming material as a function of the point-to-point degree of silver halide layer photoexposure; and c. transferring, by diffusion, at least a portion of said imagewise distribution of mobile dye image-forming material to said dyeable layer adapted to receive dye image-forming material diffusing thereto to thereby provide to said dyeable layer a dye image in terms of said imagewise distribution.

19. A process for providing a photographic diffusion transfer process dye image as defined in claim 18 including the step of converting the pH of said film unit, subsequent to substantial dye image formation in said dyeable layer, from a first processing pH provided by said processing composition to a second pH at which said dye images exhibit increased stability.

20. A process for providing a photographic diffusion transfer process dye image as defined in claim 19 wherein said dye image-forming material comprises a dye which is a silver halide developing agent and is soluble and diffusible in said processing composition at said first pH as a function of the photoexposure of said film unit and is substantially nondiffusible at said second pH.

21. A process for providing a photographic diffusion transfer process dye image as defined in claim 18 wherein said first processing pH is an alkaline pH and said second pH is > about one pH unit lower than said first pH.

22. A process for providing a photographic diffusion transfer process dye image as defined in claim 18 including the step of providing opacifying agent continguous the surface of said silver halide layer next adjacent said second dimensionally stable transparent layer.

23. A process of forming transfer images in color as defined in claim 18 wherein said second photosensitive silver halide layer comprises a particulate dispersion of photosensitive silver iodochlorobromide, silver iodochloride or silver iodobromide grains.

24. A process of forming transfer images in color as defined in claim 23 wherein said dispersion comprising said photosensitive silver halide iodochlorobromide, silver iodochloride or silver iodobromide dispersion possesses a mean grain size within the range of about 0.2 to 3.0 $\mu$.

25. A process of forming transfer images in color as defined in claim 24 wherein each of said first and second photosensitive silver halide layers comprises photosensitive silver iodochlorobromide, silver iodochloride or silver iodobromide grains.

26. A process of forming transfer images in color as defined in claim 18 wherein said dye image-providing material is a dye which is a silver halide developing agent.

27. A process for providing a photographic diffusion transfer process dye image as defined in claim 18 which comprises, in combination, the steps of:

a. exposing to incident actinic radiation a composite photographic film unit which comprises a plurality of sequential layers including a first dimensionally stable layer transparent to incident actinic radiation; a dyeable layer; an opaque layer; at least two selectively sensitized silver halide units at least one of said selectively sensitized units including a said first photosensitive silver halide layer comprising a particulate dispersion of photosentitive silver iodochlorobromide, silver iodochloride or silver iodobromide grains which possesses said first mean particle size and in contiguous parallel planar relationship thereto a said second photosensitive silver halide layer comprising a particulate dispersion of photosensitive silver halide grains which possess a mean particle size less than said first mean particle size wherein said second photosensitive silver halide layer of said composite unit is positioned intermediate the exposure surface of said film unit and said first photosensitive silver halide layer and possesses a sensitivity to incident radiation at wavelengths to which it has been selectively sensitized in excess of the sensitivity exhibited by said first photosensitive silver halide layer to said radiation at said wavelengths, and said first photosensitive silver halide layer has disposed therein said diffusion transfer process dye image-forming material; a second dimensionally stable layer transparent to incident actinic radiation; and means for securing the layers in substantially fixed relationship;

a rupturable container retaining a processing composition possessing substantially uniformly dispersed therein opacifying agent present in a quantity sufficient, upon distribution of the processing composition as a layer intermediate the second dimensionally stable transparent layer and next adjacent selectively sensitized silver halide emulsion layer, to substantially prevent transmission therethrough of incident exposure radiation actinic to the silver halide emulsion layers and the rupturable container is positioned and extends transverse an edge of the photosensitive element to effect discharge of the container's said processing composition intermediate the second dimensionally stable transparent layer and the next adjacent selectively sensitized silver halide emulsion layer;

b. effecting discharge of the container's processing composition intermediate the second dimensionally stable transparent layer and the next adjacent selectively sensitized silver halide layer;

c. effecting thereby development of each of the selectively sensitized silver halide emulsions;

d. forming thereby imagewise distributions of mobile dye as a function of development;

e. transferring, by diffusion, at least a portion of each of the imagewise distributions of mobile dye to said dyeable layer to provide a dye image in terms of the imagewise distribution; and f. maintaining the composite structure intact subsequent to processing.

28. A process for providing composite photographic diffusion transfer process dye images as defined in claim 27 which comprises, in combination, the steps of:

a. exposing to incident actinic radiation a photographic film unit which comprises a composite structure containing, as essential layers, in sequence, a first dimensionally stable alkaline solution impermeable transparent layer; an alkaline solution dyeable polymeric layer; an alkaline solution permeable inorganic light-reflecting pigment layer comprising titanium dioxide; an alkaline solution permeable opaque layer comprising carbon black; a red-sensitive silver halide emulsion unit having associated therewith cyan dye; a green-sensitive silver halide emulsion unit having associated therewith magenta dye; a blue-sensitive silver halide emulsion unit having associated therewith yellow dye, each of said cyan, magenta and yellow dyes being a silver halide developing agent and at least one of said red-, green- and blue-sensitive silver halide emulsion units comprising a composite unit including said first and second photosensitive silver halide layers each comprising a particulate dispersion of photosensitive silver iodochlorobromide, iodochloride or iodobromide grains, the dispersion comprising said first photosensitive silver halide layer possessing a mean particle size in excess of the mean particle size of the dispersion comprising said second photosensitive silver halide layer and said second photosensitive silver halide layer is positioned intermediate the exposure surface of said film unit and said first photosensitive silver halide layer and possesses a sensitivity to incident radiation at wavelengths to which it is sensitive in excess of the sensitivity exhibited by first photosensitive silver halide layer to said radiation at said wavelengths, and the cyan, magenta and yellow dye associated with a said composite unit disposed within said first photosensitive silver halide layer, each of the cyan, magenta and yellow dyes being soluble and diffusible, in alkali, at a first pH; a second dimensionally stable alkaline solution impermeable transparent layer; a polymeric layer containing sufficient acidifying capacity to effect reduction of a processing composition having the first pH at which the cyan, magenta and yellow dyes are soluble and diffusible to a second pH at which the dyes are substantially nondiffusible positioned intermediate at least one of said dimensionally stable transparent layers and next adjacent layer; and means securing said layers in substantially fixed relationship; and a rupturable container retaining an aqueous alkaline processing composition having the first pH and containing substantially uniformly disposed therein opacifying agent substantially nondiffusible from said processing composition and present in a quantity sufficient, upon distribution of the aqueous alkaline processing composition possessing the first pH as a layer intermediate the second dimensionally stable transparent layer and the blue-sensitive silver halide emulsion unit, to provide a layer possessing an optical transmission density > about six density units with respect to incident radiation actinic to the silver halide emulsion layers, and the container is fixedly positioned and extends transverse a leading edge of the photosensitive element to effect upon application of compressive force unidirectional discharge of the container's aqueous alkaline processing composition possessing the first pH intermediate the second dimensionally stable transparent layer and the blue-sensitive silver halide emulsion unit;

b. applying compressive force to the rupturable container to effect unidirectional discharge of the container's aqueous alkaline processing composition intermediate the second dimensionally stable transparent layer and the blue-sensitive silver halide emulsion unit;

c. effecting thereby development of the red-, green- and blue-sensitive silver halide emulsion layers;

d. immobilizing the cyan, magenta and yellow dyes as a result of development of their associated silver halide emulsion layers;

e. forming thereby an imagewise distribution of mobile cyan, magenta and yellow dye as a function of the point-to-point degree of exposure of their associated silver halide emulsion layers;

f. transferring, by diffusion, at least a portion of each of the imagewise distributions of mobile cyan, magenta and yellow dye to said alkaline solution permeable polymeric layer dyeable by said dyes to provide thereto a multicolor dye image;

g. transferring, by diffusion, subsequent to substantial dye transfer, a sufficient portion of the ions of the aqueous alkaline processing solution to the polymeric acid layer to thereby reduce the alkalinity of the film unit from the first pH, at which the cyan, magenta and yellow image dyes are soluble and diffusible to a second pH, at which the cyan, magenta and yellow image dyes are substantially non-diffusible; and h. maintaining the composite structure intact subsequent to processing.

29. A composite photographic diffusion transfer process film unit which comprises a plurality of sequential layers including, in combination, a first dimensionally stable transparent layer; a first dyeable layer adapted to receive diffusion transfer process dye image-forming material diffusing thereto; an opaque layer;

at least two selectively sensitized silver halide units at least one of said selectively sensitized units including a first photosensitive silver halide layer comprising a particulate dispersion of photosensitive silver iodochlorobromide, silver iodochloride or silver iodobromide grains which possesses a first mean particle size, said first layer having disposed therewithin a diffusion transfer process dye image-forming material possessing spectral absorption within the spectral range to which said grains are sensitive and in contiguous relationship thereto a second photosensitive silver halide layer substantially free of diffusion transfer process dye image-forming material, comprising a particulate dispersion of photosensitive silver halide grains which possess a second mean particle size less than said first mean particle size wherein said second photosensitive silver halide layer of said composite unit is positioned intermediate the exposure surface of said film unit and said first photosensitive silver halide layer, is substantially spectrally sensitive within said spectral range and possesses a sensitivity to incident radiation at wavelengths to which it has been selectively sensitized greater than the sensitivity exhibited by said first photosensitive silver halide layer to said radiation at said wavelengths;

a second dimensionally stable transparent layer; means for providing a processing composition intermediate the second dimensionally stable transparent layer and the next adjacent silver halide layer; means for providing opacifying agent intermediate the second dimensionally stable layer and the next adjacent silver halide layer in a quantity effective to prevent exposure of the photosensitive silver halide layers during processing of the film unit in the presence of radiation actinic to the photosensitive layers and incident on said second dimensionally stable transparent layer and the opaque layer is effective to prevent exposure of said photosensitive layers during processing of said film unit in the presence of radiation actinic to the photosensitive layers and incident on said first dimensionally stable layer; means for maintaining the composite unit intact subsequent to diffusion transfer processing; said layers arranged in substantially parallel planar relationship; and said dimensionally stable layers being externally disposed with respect to the other of said layers.

30. A photographic diffusion transfer color process film unit as defined in claim 29 wherein each of the selectively sensitized silver halide units possesses predominant spectral sensitivity to separate regions of the spectrum and the dye image-forming material associated with each of said silver halide layers possesses a spectral absorption range subsequent to processing substantially complementary to the predominant sensitivity range of its associated silver halide layer.

31. A photographic diffusion transfer color process film unit as defined in claim 30 wherein said selectively sensitized silver halide layers of said composite unit each comprise silver iodochlorobromide, iodochloride or iodobromide grains possessing a mean grain size within the range of about 0.2 to 3.0 $\mu$.

32. A photographic diffusion transfer color process film unit as defined in claim 31 wherein said photosensitive silver halide of said composite unit is present at a coverage of 40 to 200 mgs./ft.$^2$ silver halide and said dye image-forming material is present in a ratio of 1.5 to 0.4 dye to silver halide.

33. A composite photographic diffusion transfer process film unit as defined in claim 29 wherein said color film unit includes means for converting the pH of said processing composition, subsequent to substantial diffusion dye image-forming materials to said dyeable layer, from a first alkaline processing pH to a second pH less than said first pH at which the dye transfer image provided by said dye image-forming materials exhibits increased stability.

34. A composite photographic diffusion transfer process film unit as defined in claim 29 wherein said selectively sensitized silver halide units include, as essential layers, a red-sensitive silver halide emulsion layer having associated therewith a diffusion transfer process cyan dye image-forming material, a green-sensitive silver halide emulsion layer having associated therewith a diffusion transfer process magenta dye image-forming material and a blue-sensitive silver halide emulsion layer having associated therewith a diffusion transfer process yellow dye image-forming material.

* * * * *